United States Patent [19]

Wacker et al.

[11] Patent Number: 4,887,770

[45] Date of Patent: Dec. 19, 1989

[54] ELECTROSTATIC ROTARY ATOMIZING LIQUID SPRAY COATING APPARATUS

[75] Inventors: Robert L. Wacker, Wellington; Donald E. Shuster, Elyria; John Sharpless, Oberlin; Alan J. Knobbe, Lorain; James C. Murphy, Broadview Heights, all of Ohio

[73] Assignee: Nordson Corporation, Westlake, Ohio

[21] Appl. No.: 300,114

[22] Filed: Jan. 19, 1989

Related U.S. Application Data

[63] Continuation-in-part of Ser. No. 14,450, Feb. 13, 1987, abandoned, which is a continuation-in-part of Ser. No. 853,746, Apr. 18, 1986, abandoned.

[51] Int. Cl.[4] ..... B05B 5/04

[52] U.S. Cl. ..... 239/703; 239/691; 239/110; 239/224

[58] Field of Search ..... 239/700–703, 239/222.11, 223, 224, 690, 691, 104, 106, 110

[56] References Cited

U.S. PATENT DOCUMENTS

| | | | |
|---|---|---|---|
| D. 232,830 | 4/1974 | Moos | D23/1 |
| 2,893,893 | 7/1959 | Crouse | 117/93 |
| 3,051,394 | 8/1962 | Sedlacsik, Jr. | 239/703 |
| 3,279,429 | 10/1966 | Felici et al. | 239/704 |
| 3,408,985 | 11/1968 | Sedlacsik, Jr. | 118/629 |
| 3,590,318 | 6/1971 | Probst et al. | 317/3 |
| 3,826,425 | 7/1974 | Scharfenberger | 239/15 |
| 3,870,233 | 3/1975 | Wilhelm et al. | 239/112 |
| 4,011,991 | 3/1977 | Masuda | 239/15 |
| 4,337,895 | 7/1982 | Gallen | 239/7 |
| 4,378,091 | 3/1983 | Morishita et al. | 239/703 |
| 4,380,321 | 4/1983 | Culbertson et al. | 239/700 |
| 4,422,577 | 12/1983 | Arnold et al. | 239/703 |
| 4,520,949 | 6/1985 | Seitz et al. | 222/108 |
| 4,555,058 | 11/1985 | Weinstein et al. | 2139/223 |
| 4,572,437 | 2/1986 | Huber et al. | 239/703 |
| 4,589,597 | 5/1986 | Robisch et al. | 239/703 |

FOREIGN PATENT DOCUMENTS

| | | |
|---|---|---|
| 45987 | 8/1984 | Australia . |
| 1202215 | 3/1986 | Canada . |
| 0120648 | 10/1984 | European Pat. Off. . |
| 2048639 | 6/1972 | Fed. Rep. of Germany . |
| 2066701 | 7/1981 | United Kingdom . |

*Primary Examiner*—Robert J. Oberleitner
*Assistant Examiner*—Karen B. Merritt
*Attorney, Agent, or Firm*—Wood, Herron & Evans

[57] ABSTRACT

Electrostatic liquid spray coating apparatus including a rotary atomizing cup of insulative material driven by an air turbine, is provided with a semi-conductive charging device extending through the cup, the inner portion of which is proximate the inner surface of the cup for contact charging liquid coating material supplied to the rear of the cup as it flows forwardly and outwardly over the rotating cup interior and contacts the charging device prior to atomization at the forward edge of the cup. A generally cylindrical insulative support body, housing a turbine and its associated air bearing and cup drive shaft, has a reduced diameter intermediate section which provides an annular cavity in which are located liquid coating and solvent valves for controlling the flow of liquid coating and solvent to the cup. The charging means in the cup is energized via a stationary conductor which terminates in closely spaced proximity to the outer portion of the charging device on the cup exterior which is electrically connected to the inner portion of the charging device on the cup interior via a series of semi-conductive posts which form the portion of the charging device extending through the wall of the cup between its inner and outer surfaces.

47 Claims, 8 Drawing Sheets

ELECTROSTATIC ROTARY ATOMIZING LIQUID SPRAY COATING APPARATUS

This Case is a continuation-in-part of co-pending U.S. patent application Ser. No. 014,450, filed. Feb. 13, 1987 now abandoned, which is a continuation-in-part of U.S. patent application Ser. No. 853,746, filed Apr. 18, 1986, and now abandoned.

This invention relates to electrostatic spray coating and more particularly to electrostatic liquid spray coating apparatus utilizing rotary atomization.

Electrostatic spray coating apparatus incorporating rotary atomizers have been available for many years. Typically a conductive cup or disc maintained at high voltage is rotated at very high speed causing liquid coating material fed to the central part of the cup or disc to migrate outwardly over the cup or disc surface under centrifugal force, eventually leaving the cup or disc at the outer edge thereof where it becomes atomized. Because the atomizing edge of the cup or disc is sharp, the high voltage applied to the conductive cup or disc causes ionization of the air in the region of the atomizing edge, imparting electrostatic charge to the atomized liquid coating particles in a manner well known in the field of electrostatic spray coating.

Over the years the hazards associated with the use of conductive atomizing cups and discs maintained at high voltage, which take the form of personnel shock and ignition when combustible coatings are employed, have become well publicized. In brief, the hazards exist by virtue of the fact that substantial electrical energy is stored in capacitive form by a conductive cup or disc maintained at high voltage which can rapidly discharge if inadvertently grounded or brought near a grounded object. To minimize these hazards various solutions have been proposed. For example, it has been proposed to make the atomized cup or disc of insulative material except for a conductive skin or layer which is provided on the surface of the atomizing member to conduct high voltage to the atomizing edge for the purpose of creating ionization thereat. Another proposal involves making the atomizing cup or disc of resistive material. These and other proposals are contained in U.S. Pat. Nos.: Gauthier 2,926,106, Gauthier 2,989,241, Schotland 2,955,565, Juvinall 3,009,441, Sedlacsik 3,010,428, Gauthier 3,021,077, Juvinall et al 3,048,498, Point 3,063,642, Point et al 3,072,341, Gauthier 3,083,121, Gauthier 3,128,045, Point 3,178,114, Felici et al 3,279,429, Scharfenberger et al 3,826,425, Point 3,075,706, and Robisch et al PCT International Publication No. WO 85/01455.

The foregoing proposals have not been entirely satisfactory for various reasons, one of which is that the resulting transfer efficiency of the spray apparatus has not been sufficient to satisfy those desiring high coating transfer efficiencies in the range of 90% and above. By coating transfer efficiency is meant the percentage or proportion of coating material emitted from the spray device which actually gets coated. Accordingly, it has been an objective of this invention to provide a safe electrostatic spray device of the rotary atomizing type which affords high coating transfer efficiency. This objective has been accomplished in accordance with certain of the principles of this invention by providing an electrostatic spray coating device with a rotary atomizer of insulative material having a first surface over which liquid coating can flow outwardly to an atomizing edge thereof when the atomizer is rotated about its axis of rotation and a second surface separated from the first surface by the atomizing edge.

Charging means are provided extending through the atomizer wall between its inner and outer surfaces. The charging means has an inner portion positioned proximate the atomizer inner surface and an outer portion positioned proximate the atomizer outer surface and electrically connected to the inner portion. At least one stationary electrical conductor, but preferably a plurality of stationary electrical conductors, each having a free end located in closely spaced proximity to the outer portion of the charging means are provided. The stationary electrode or electrodes facilitate transfer of electrostatic energy to charging means when the stationary conductor is energized from a high voltage source, enabling contact charging of liquid coating supplied to the first surface when the coating flows under centrifugal force outwardly over the first surface in contact with the inner portion of the charging means toward the atomizing edge.

By minimizing the amount of conductive material incorporated in the rotating atomizer, electrical energy stored in capacitive form by the atomizer is kept within safe limits while providing high transfer efficiency. This is due to the position of the stationary electrode or electrodes and their associated moving outer portions of the charging means proximate the outer surface on the rotating atomizer and the contact charging provided the inner portion of the charging means proximate the inner surface of the atomizer over which the coating flows under centrifugal force as it migrates toward the atomizing edge.

In a preferred form of the invention the safety of the spray apparatus is even further enhanced by fabricating of semiconductive material the charging means extending through the atomizer, including its inner portion, its associated outer portion and the connecting portion therebetween.

In one preferred embodiment of the invention, the charging means includes (1) an inner portion in the form of a circular ring-shaped charging electrode mounted on the inner surface of the atomizer encircling the axis of rotation, (2) an outer portion in the form of a circular electrical current-conducting element mounted on the outer surface of the atomizer encircling the axis of rotation, and (3) means mounted on the atomizer connecting the circular electrode and the electrical current carrying element.

In a second embodiment of the invention, the charging means extends through the atomizer between its inner and outer surfaces with an inner portion proximate the inner surface of the atomizer to be contacted by liquid coating flowing outwardly over the inner surface, and an outer portion proximate the outer surface of the atomizer. In this embodiment, the inner portion is in the form of a circular ring-shaped charging electrode mounted on the inner surface of the atomizer encircling the axis of rotation. Preferably, a plurality of posts extend through the atomizer connecting the ring with the outer surface where the outer ends of the posts form the outer portion of the charging means.

In a third preferred embodiment, the charging means is in the form of a plurality of discrete conductive or semiconductive posts, circumferentially spaced about the atomizer axis of rotation, each extending through the atomizer between its inner and outer surfaces. The inner ends of the posts form the inner portion of the charging means to be contacted by the liquid coating and the outer ends of the posts form the outer portion of the charging means. While use of a charging electrode ring is highly effective in transferring charge to the fluid film, use of a large plurality of discrete charging electrodes, for example sixteen, circumferentially spaced about the inside surface of the atomizer, is nearly as effective while providing greater safety due to its lesser amount of charge holding surface. Although a smaller number of electrodes diminishes somewhat the effective transfer of charge, safety is further increased by doing so. The same principles apply with respect to the configuration of the outer portion of the charging means. Accordingly, selection of embodiments of the invention most suitable for particular applications can be made by consideration of these criteria.

Further according to the invention and for the purpose of still further improving the safety of the spray apparatus, the free ends of the electrodes which transfer electrical energy to the charging means on the atomizer, as well as the outer portion of the charging means on the outer surface of the cup, are protected from damage and inadvertent contact by being located substantially within the recess in which the atomizer cup rotates.

In accordance with certain other features of the invention designed to promote compactness of the spray coating apparatus, the support body of the spray apparatus in which the drive means for the rotary atomizer is encased is provided with a generally cylindrical exterior shape in which the diameter of the intermediate section is substantially less than that of the forward and rear body sections, defining an annular cavity therebetween in which are located the liquid coating and cleansing solvent valves for controlling the flow of liquid coating and solvent to the rotary atomizer. This enables the liquid coating and solvent valves to be located not only in close proximity to the rotary atomizer, but also to be located within the overall envelope of the support body which houses the rotary drive assembly for the atomizer.

To facilitate mounting of the spray apparatus to a post or the like, a mounting bracket is provided of desired design from which project in a forward direction several spaced parallel columns which at their forward end mount the support body of the spray apparatus housing the various valves and the drive assembly for the rotary atomizing element. In a preferred form, one of the columns is hollow for housing an electrostatic energy-conducting core for transporting high voltage electrostatic energy between a remote high voltage source and the stationary electrode which is located in close proximity to the circular conducting element on the rotating atomizer which is connected to the circular charging electrode. In the preferred embodiment, the hollow column also encases a gun resistor which is in series with the stationary conductor.

In accordance with certain additional principles of the invention, an annular air ring provided with a circular array of forwardly directed air jet-defining ports is removably mounted to the front of the support body. The air ring includes an annular recess in the rear wall thereof, which functions as a circular air manifold for distributing air to the circular array of passages to establish air jets for shaping the atomized liquid coating spray. The air ring rear wall also includes an annular recess which encloses a single circular conductor which is supplied with high voltage from the remote electrostatic source. The circular conductor has connected to it the plural stationary conductors which transfer electrostatic energy to the charging means of the cup. In one preferred form the stationary conductor or conductors are located in sheaths which are removably threaded into suitably threaded bores in the front surface of the air ring. The sheaths may also house charging resistors in series circuit with the stationary conductors. The foregoing construction has been found to be relatively simple to manufacture, assemble, and maintain.

In an alternate embodiment of the invention, the annular air ring takes the form of a cap having an outer face which is aerodynamically contoured to help avoid eddy currents generated by the flow of air along the outside surface of the rotary atomizer cup. This improves transfer efficiency and reduces fouling of the sprayer with coating material by helping to avoid drawing the spray pattern back toward the sprayer. The base of the cap includes a groove which encloses a first circular conductor which is supplied with high voltage from the remote electrostatic source while the outer face of the cap includes a repulsion ring recessed about its periphery. The repulsion ring is electrically connected to the first circular conductor as to be energized with at the same electrical polarity as the charge imparted to the atomized droplets of coating material in order to further enhance transfer efficiencies and avoid the buildup of coating material on the sprayer.

Instead of using sheaths threaded into an air ring, the alternate embodiment of the invention contemplates locating the plural stationary conductors and associated charging resistors imbedded within the cap. This protects and stabilizes the charging resistors and associated leads and helps shorten the overall length of the spray apparatus. Further according to the invention, the cap preferably includes a slightly oversized recess in which the atomizing cup is disposed to thereby define a gap between the wall of the recess and the outer surface of the cap. To help prevent the charging electrodes from being accidentally contacted, the free ends thereof and the circular conductor on the outside of the atomizing cup are each located substantially within the gap.

These and other features, advantages, and objectives of the invention will become more readily apparent from a detailed description thereof taken in conjunction with the drawings which: are described briefly as follows and wherein like numerals refer to like items.

BRIEF DESCRIPTION OF THE DRAWINGS

With reference to FIGS. 1 and 2, the rotary atomizing liquid spray coating device of this invention is seen to include a support body 10 having a front or forward section 12 and a rearward section 14 between which is positioned an intermediate section 16. The body sections 12, 14, and 16 are generally cylindrically shaped. The diameter of the forward and rear body sections 12 and 14 are substantially the same. The diameter of the intermediate body section 16 is substantially less than that of the body sections 12 and 14, defining therebetween an annular cavity 18 within which can be located and mounted, as will be described in more detail hereafter, various valves for controlling the flow of liquid coating material and solvent for cleansing the interior and exterior of the rotary atomizing cup described hereafter.

Figure 1:
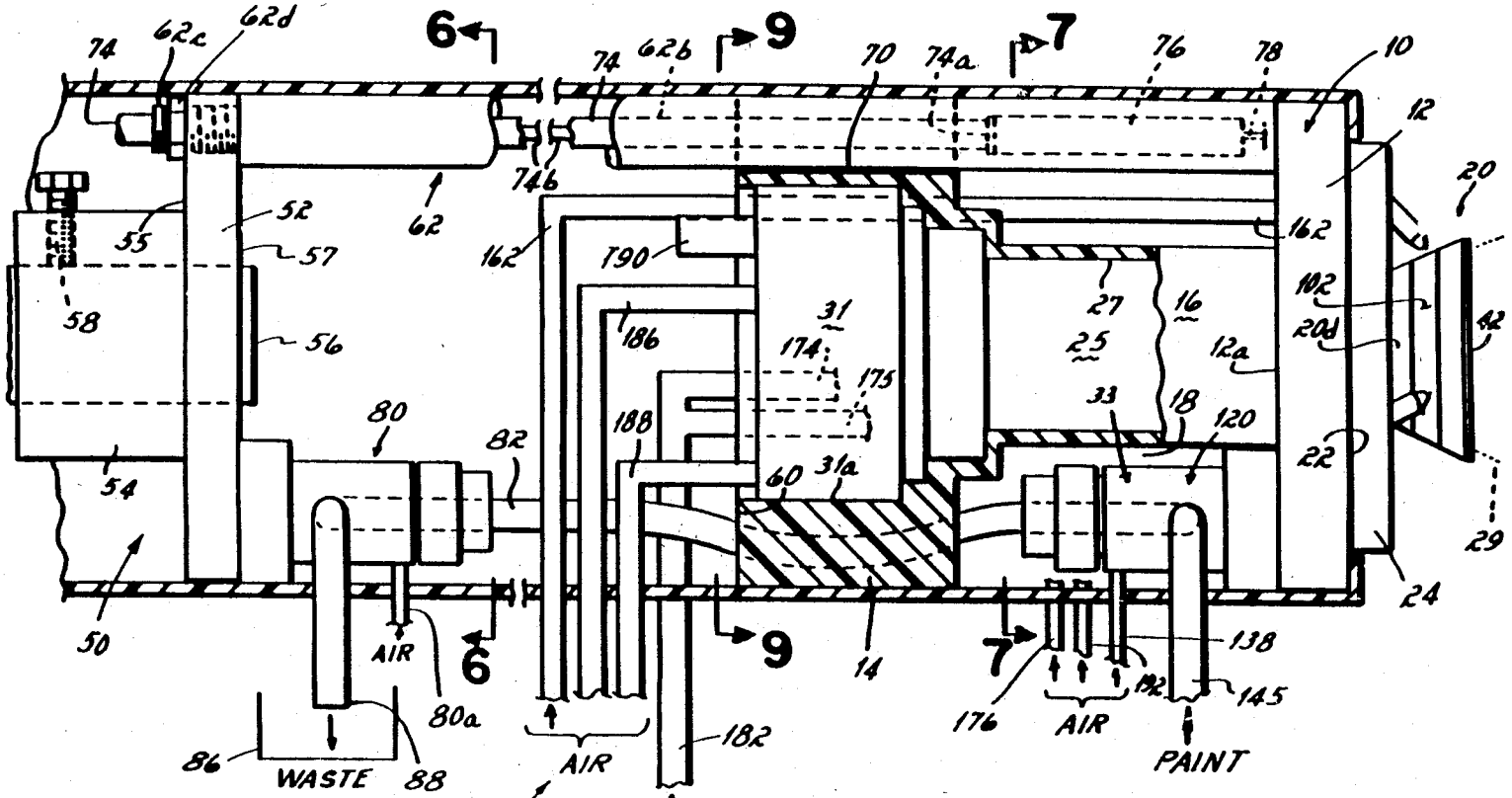
FIG. 1 is a side elevational view, partially in cross section, of the rotary atomizing liquid spray coating device of this invention.

A rotary atomizing cup 20 extends forwardly from the front surface 22 of the forward body section 12. Removably secured to the front surface 22 of the forward section 12 of the body 10 in any suitable manner, such as by bolts, threaded engagement, or the like, is an annular ring 24. The ring 24 includes a circular air passage or manifold 26 formed in the rear surface thereof from which extend forwardly a plurality of circularly arranged air ports 28 for establishing a circular array of air jets for shaping the atomized liquid coating spray pattern 29 formed at the forward edge or rim 42 of the atomizing cup 20.

As noted, extending forwardly from the forward section 12 of the body 10 is the rotary atomizing cup 20. Cup 20 is drivingly mounted on a shaft 23 for rotation about its axis. The cup drive shaft 23 extends through a bore 12*b* in forward body section 12 and an air or ball bearing 25 of a conventional commercially available type located within a suitably configured bearing cavity or bore 27 in intermediate body section 16. Shaft 23 is driven at its rear (left as viewed in FIG. 2) by a rotary actuator 31, such as an air-driven turbine, also of a conventional commercially available type which is located rearwardly of the bearing 25 in a turbine cavity or bore 31*a* in rear body section 14. A liquid coating control valve 33 mounted to the rear surface of the flange-defining portion of the forward section 12 of the body 10 controls the flow of liquid coating material to a coating nozzle 30 via a passage 32 formed in the forward section 12 of the body 10. Liquid coating under slight pressure exiting nozzle 30 enters an annular cavity 34 formed in the rear section of the cup 20. Under centrifugal force due to the rotation of cup 20 by drive shaft 23, the liquid coating material in the annual cavity 34 passes radially outwardly and forwardly through a series of coating passages 36 in radial cup wall 20*c* to a forward cup cavity 38. Once in the forward cup cavity 38 the liquid coating moves radially and forwardly along a first surface defined by interior cup wall 40 toward the forward atomizing edge 42 of the cup 20 whereat it is atomized under centrifugal force to form the atomized spray pattern 29. A flat circular ring-shaped charging electrode 46 imbedded in the interior wall 40 which is connected to a conventional high voltage electrostatic supply (not shown) in a manner to be described, charges the liquid coating material by contact as it passes thereover in its movement from passages 36 in wall 20*c* to the forward atomizing edge 42 of the cup whereat the liquid is centrifugally atomized to form spray pattern 29.

Disposed rearwardly of the body 10 and spaced therefrom is a mounting bracket 50. Bracket 50 consists of a circular plate 52 and a rearwardly extending collar 54. The plate 52 and collar 54 are provided with a through bore into which can be positioned a circular post 56 supported in any suitable manner by a spray reciprocating device, stationary pedestal, or the like. A locking screw 58 threaded radially into the wall of collar 54 is provided for locking the bracket 50 on the post 56.

Extending between the circular plate 52 and the rear surface 60 of the rear section 14 of the body 10 are several mounting posts or columns 62, 64, and 66. Columns 64 and 66 can be fastened in any suitable manner to the plate 52 and the rear wall 60 of the rear section 14 of the body 10. For example, columns 64 and 66 can be threaded at their forward ends and screwed into suitably provided threaded bores in the rear wall 60 of the rear section 14 of the body 10. The columns 64 and 66 at their rearward ends may be provided with reduced diameter portions which extends through suitably provided bores in the plate 52 such that they project rearwardly (leftwardly as viewed in FIG. 1) of rear surface 55 of the plate 52. By providing threads on the reduced diameter portion of the rear ends of the columns 64 and 66 which project rearwardly of the plate surface 55, nuts can be used to secure the rearward ends of the columns 64 and 66 to the plate 52, as is done with the rear end of column 62 in a manner to be described.

The support column 62 at its rear or left end has a reduced diameter portion 62*c* which passes through a suitable bore in plate 52, extending rearwardly of surface 55 thereof. A nut 62*d* threadedly engages the column end portion 62*c* to secure column 62 to plate 52. The support column 62 at its forward end passes through a suitably provided bore 70 in the rear section 14 of body 10 and extends forwardly to the rear wall 12*a* of the forward body section 12. The forwardmost portion 62*a* of the column 62 is of reduced diameter and threaded such that it will threadably engage a suitable threaded bore 72 formed in the rear surface 12*a* of the forward body section 12.

The column 62 is provided with an axial internal bore 62*b* within which is positioned a high voltage insulated cable 74 connected at its rearward end to a high voltage electrostatic supply (not shown). The cable 74 at its forward end 74*a* connects to a gun resistor 76. An electrical conductor 78 extends between the forward end of the gun resistor for energizing the electrode 46 in a manner to be described in more detail hereafter.

As shown in FIG. 1, a dump valve 80 mounted to the forward wall 57 of the plate 52 connects to the liquid coating valve 33 via a flexible conduit 82 and to a waste receptacle 86 via a conduit 88. Dump valve 80 diverts cleansing solvent from coating valve 33 during color change operations in a manner well known in the art.

Mounted to the rear surface 12*a* of the flange-defining portion of forward body section 12, in addition to the coating control valve 33, are solvent valves 90 and 92 which control the flow of solvent, in a manner to be described, to the exterior of the rotary atomizing cup 20 and the interior of the rotary atomizing cup, respectively, as shown in FIGS. 3, 4, 7, and 8. Valves 90 and 92 are located in the annular cavity 18.

Figure 2:
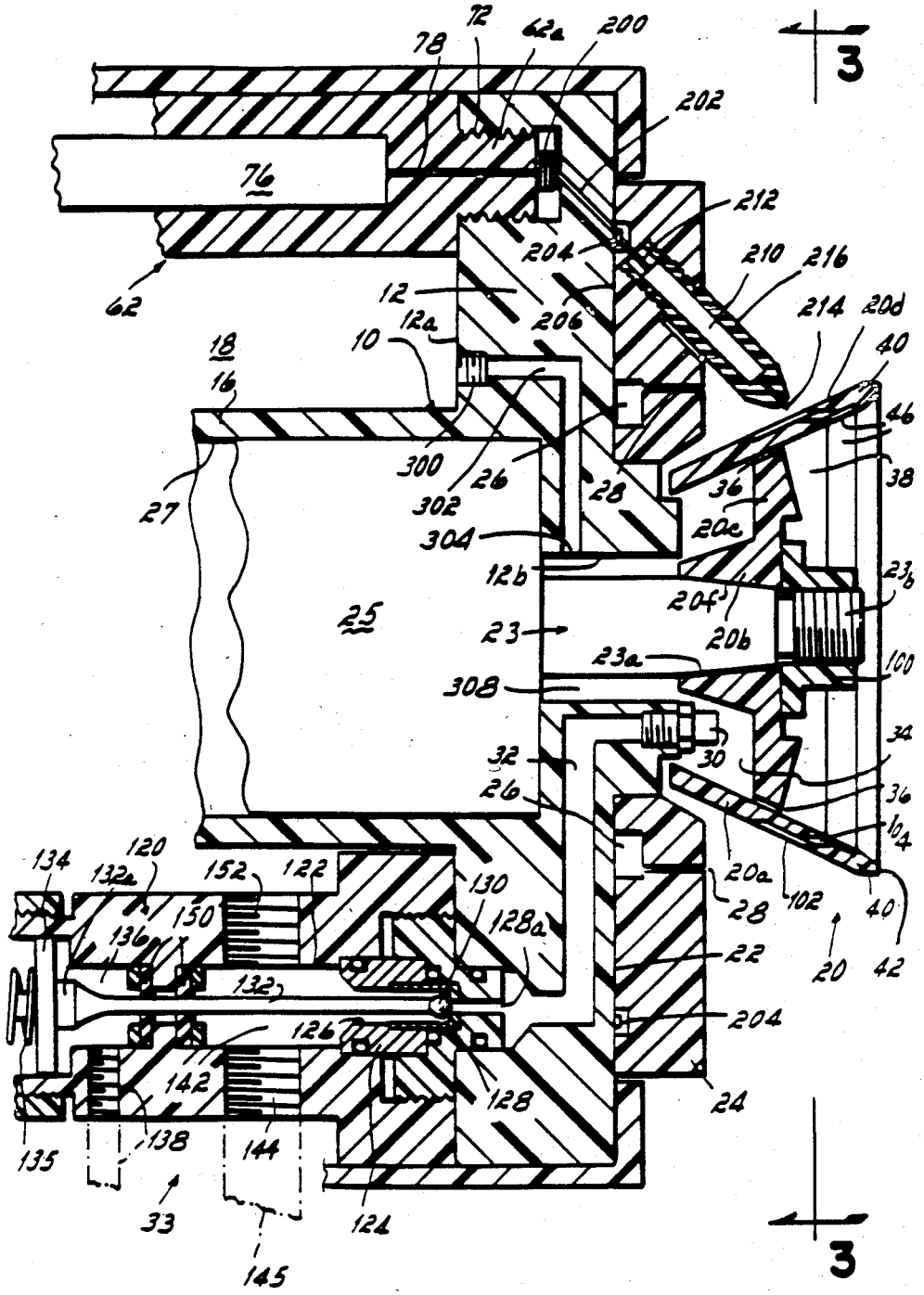
FIG. 2 is a side elevational view, in cross section, of the front section of the rotary atomizing liquid spray coating device depicted in FIG. 1, showing, among other things, the general relationship of the atomizing cup and its rotary drive, air jets for shaping the atomized coating spray, high voltage circuit paths, and liquid coating flow path and associated valve.
Figure 3:
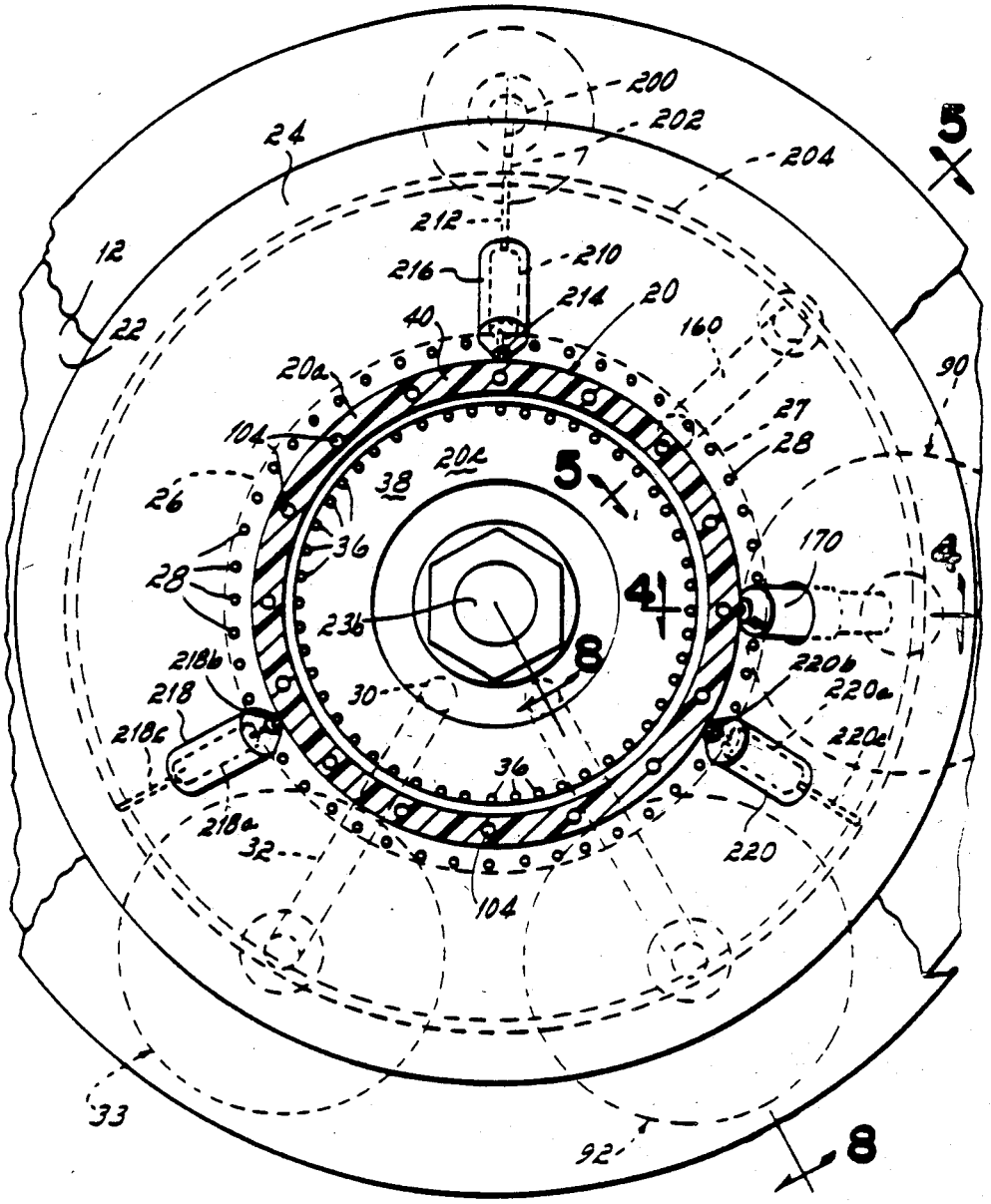
FIG. 3 is a cross-sectional view along line 3—3 of FIG. 2 showing, among other things, portions of the liquid coating and solvent flow paths to the rotary atomizing cup, as well as the general location of their respective valves, a portion of the air path for shaping the liquid coating spray pattern, and the electrical conductors which transmit high voltage to the ring-shaped liquid coating charging electrode mounted inside the atomizing cup.

The rotary atomizing cup 20, as best seen in FIG. 2, includes a frusto-conical tubular section 20*a* and a hub 20*b* which are interconnected by radial wall 20*c* which collectively define the rear annular cavity 34 and the forward cavity 38. The nonuniform cross section of the tubular section 20 increases along the axis thereof in the direction of the atomizing edge 42. The hub 20*b* is provided with a tapered bore 20*f* which snugly engages a similarly tapered portion 23*a* of the drive shaft 23. The forward end 23*b* of the drive shaft 23 is threaded for threadedly receiving a retaining nut 100 which locks the hub 20*b* of the cup 20 in place on the drive shaft 23. Imbedded in the outer surface 20*d* of the frustoconical section 20*a* of cup 20, in the embodiment illustrated in FIG. 2, a circular current-conducting flat ring element 102, preferably of semiconductive material. Ring element 102 is electrically connected to the flat electrode 46, which is also preferably fabricated of semiconductive material, via a series of conducting means in the form of pins 104 seated in suitably provided bores in the cup section 20*a*. The pins 104, which are preferably of semiconductive material, at their opposite ends are in electrical contact with the confronting surfaces of the ring 102 and electrode 46. The cup 20 is preferably made of insulative material, as is the nut 100, shaft 23, bearing 25, annular ring 24, body 10, rotary actuator 31, valves 33, 80, 90, and 92, and associated fluid conduits, mounting bracket 50, and mounting columns 62, 64, and 66 for the purpose of minimizing the storage of electrical energy in capacitive form in the spray coating device. A preferred type of insulating material for the cup 20 is PEEK (polyetheretherketone) available from I.C.I. of America, and for the remaining insulative elements is ERTALYTE (polyester) available from Erta Incorporated, Malvern, Pennsylvania.

Surrounding the bracket 50 and body 10, as well as the various valves, is a tubular housing, as best shown in FIG. 1, for enclosing the various operating components of the spray device. The housing is preferably fabricated of insulative material.

The liquid coating valve 33, which may be of any conventional type, preferably includes a valve body 120 having a stepped diameter bore 122. Located in the forward end of the bore 122 is a valve seat insert mount 124 having a bore 126 within which is positioned a valve seat insert 128 having an axial passage 128*a* which is normally blocked by a ball valve element 130 formed at the forward end of a reciprocable rod 132 which is normally forwardly biased to close the valve by a spring-biased air-operated piston 134 secured to the rear end 132*a* of the shaft 132. A spring 135 normally biases the piston 134 in a forward direction (rightwardly as viewed in FIG. 2). An air chamber 136 connects to a source of pressurized air via a passage 138 in the wall of the rear portion of the valve body 120. When pressurized air is admitted into the chamber 136 via passage 138 under control of means not shown, the piston 134 is urged rearwardly (leftwardly) to unseat the ball valve element 130 relative to the seat of the seat insert 128, interconnecting passage 128*a* with a liquid coating chamber 142. Chamber 142 communicates with a source of pressurized liquid coating (not shown) via a passage 144 formed in the wall of the valve body 120 which connects to a coating supply conduit 145.

Thus, when pressurized air is admitted into cavity 136 via passage 138 urging the piston 134 rearwardly and unseating the valve ball element 130, pressurized liquid coating in chamber 142 passes through passage- way 128*a* into the passageway 32 of the forward body section 12 whereupon it exits under pressure from the nozzle 30 into the rear cavity 34 of the rotary cup 20. In a manner described heretofore, the liquid coating material in rear cavity 34 flows through passages 36 along interior wall 40 of the forward cavity 38 over flat ring electrode 46 whereat the coating material is electrostatically charged. Eventually the charged electrostatic coating is atomized at the forward edge 42 of the cup 20 to form spray pattern 29.

Air cavity 136 and coating cavity 142 are separated by suitable seals 150 which permit axial reciprocation of the rod 132. The cavity 142 of the valve 33 connects via passage 152 formed in the wall of the valve body 120 to the conduit 82, ultimately being passed to a waste receptacle 86 via the dump valve 80 and the conduit 88. The dump valve 80 is substantially identical to the valve 33, except it has, in addition to a single inlet passage, only one outlet passage for the flow of liquid coating material. The dump valve 80, like the valve 33, is air-operated and for this purpose has a controlled source of pressurized air (not shown) connected to it via an air hose 80*a*.

Shaping of the atomized liquid coating spray pattern 29 emanating from the forward edge 42 of the rotary atomizing cup 20, as previously noted, is provided by a circular air passage 26 formed in the annular ring 24 which feeds a plurality of circularly arranged axially extending ports 28 which establish forwardly projecting air jets. To provide pressurized air to the circular air passage 26 formed in annular ring 24, the forward body section 12 is provided with a passage 160 which at its forward end communicates with the circular air passage 26 and at its rearward end connects to a suitable source of pressurized air (not shown) via a hose 162. Control means, also not shown, regulate the flow of air in the hose 162 in a conventional manner. When pressurized air is provided to the hose 162, air is emitted under pressure from the circularly arranged ports 28 in a forwardly direction, shaping the electrostatically charged atomized liquid coating particle spray pattern 29, as desired.

When it is desired to change the color of the liquid coating material being sprayed from the device of this invention, solvent is introduced into the port 144 of the valve 33, in a manner well known in the art, and the valve 80 opened. The solvent flows through and flushes the valve 33, the passage 32, and nozzle 30, as well as through passage 152 and hose 82 to the dump valve 80, allowing the solvent to pass through the dump valve into the waste receptacle 86 via hose 88. Cleansing of the exterior surface 20*d* of liquid coating material with solvent as an incident to color change is provided by means of a solvent nozzle 170 threaded into a suitably provided bore 172 in the front surface 22 of the forward body section 12. The passage 172 at its rear end connects to the output port 90*a* of the solvent valve 90. Connected to the input port 90*b* of the solvent valve 90 is a solvent hose 174 supplied from a suitable source of pressurized solvent (not shown). The valve 90 is constructed substantially identical to dump valve 80 and, like dump valve 80, is provided with an air-operated ball valve element 90*c* at the forward end of a rod 90*d* controlled by a spring-biased air-actuated piston 90*e*. A controlled source of pressurized air is connected to the valve 90 via a suitable air hose 176 to actuate the valve, as desired.

Figure 4:
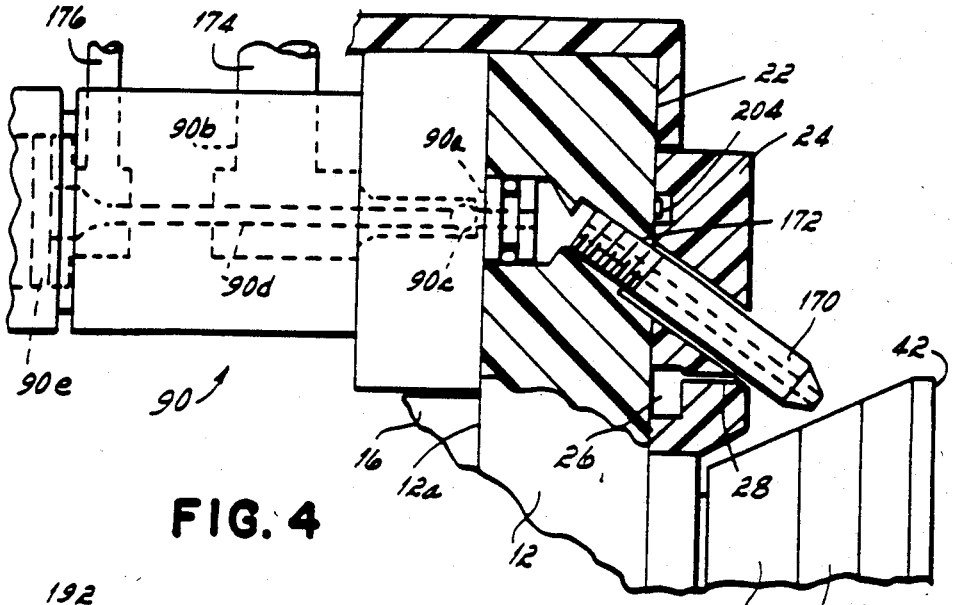
FIG. 4 is a cross-sectional view along line 4—4 of FIG. 3 showing the flow passages and valving for solvent for cleansing the exterior of the rotary atomizing cup.
Figure 8:
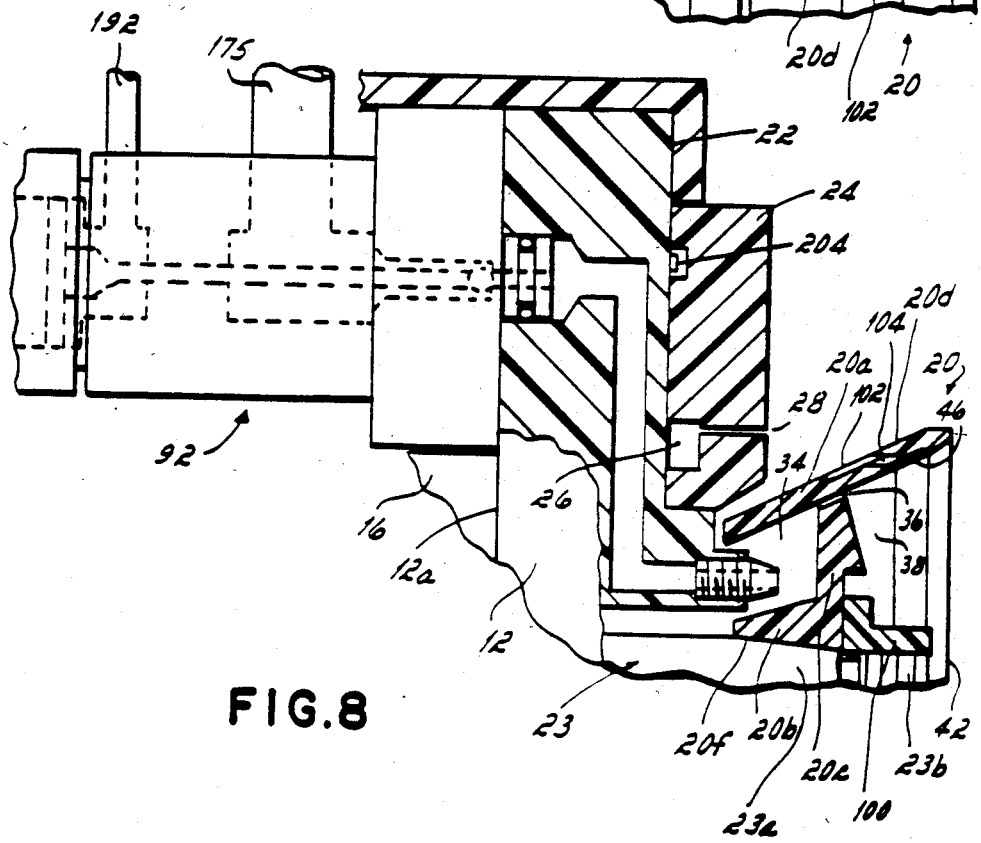
FIG. 8 is a cross-sectional view along line 8—8 of FIG. 3 showing the flow passages and valving for solvent for cleansing the interior of the rotary atomizing cup.
Figure 5:
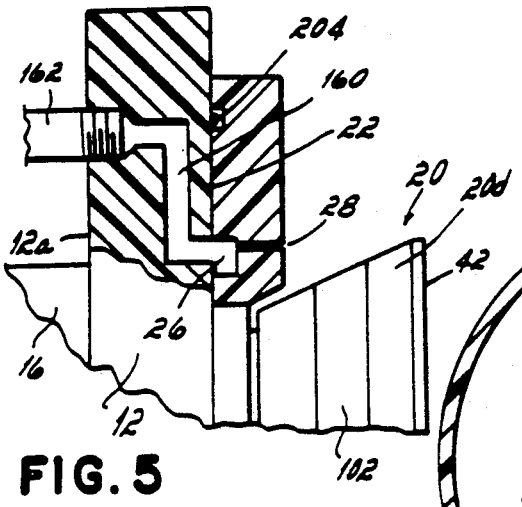
FIG. 5 is a cross-sectional view along line 5—5 of FIG. 3 showing a portion of the path for the air for shaping the atomized liquid spray coating pattern.
Figure 6:
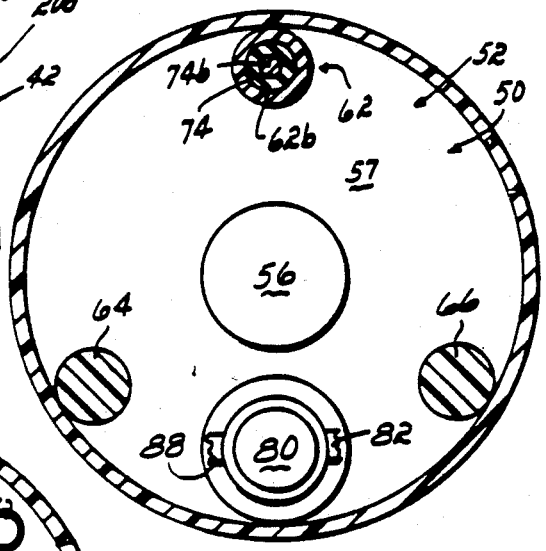
FIG. 6 is a cross-sectional view along line 6—6 of FIG. 1 showing the general relationship of the support columns between the front and rear body sections of the spray device, the housing, and the dump valve.
Figure 7:
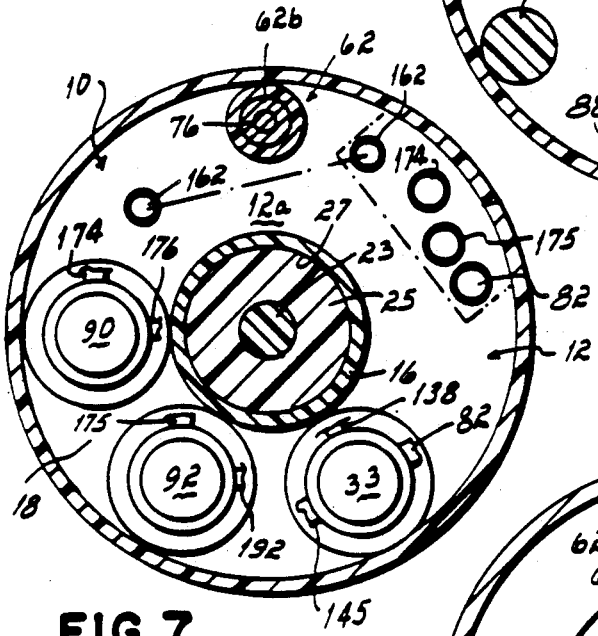
FIG. 7 is a cross-sectional view along line 7—7 of FIG. 1 showing the general relationship of the valves for the liquid coating material and the solvent for cleansing the interior and exterior of the rotary liquid atomizing cup.
Figure 9:
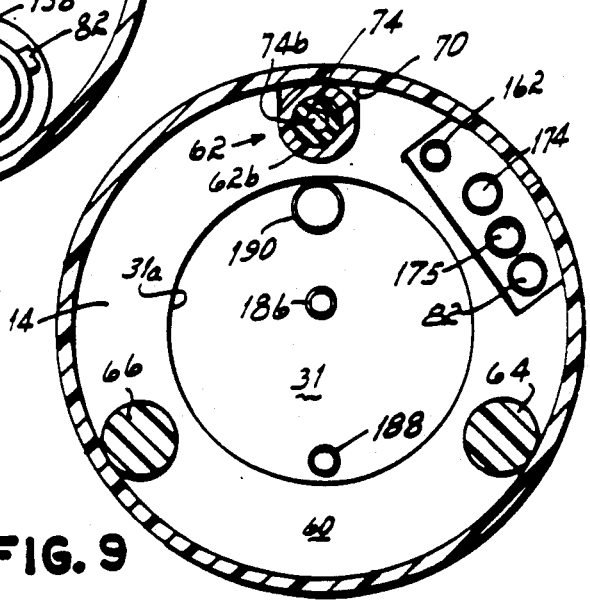
FIG. 9 is a cross-sectional view along line 9—9 of FIG. 1 showing the rear body section of the spray device, support columns, and various air and solvent hoses.

To cleanse the rearward cup cavity 34, passages 36, and forward cup cavity 38 of coating material as an incident to color changing, a solvent nozzle 94 and valve 92 shown in FIG. 8 is provided, the valve being substantially identical to that shown in FIG. 4 for cleansing the exterior surface of the atomizing cup 20. The only difference between the solvent cleansing nozzle 94 and valve assembly 92 for cleansing the interior of the cup 20 and the nozzle 170 and valve 90 for cleansing the exterior of the cup is that the nozzle 94 for cleansing the interior of the cup projects from the forward surface section 22*a* of the forward body section 12 into the rear cavity 34 of the cup 20. The coordination of the various valves to effect color change and the flushing of the valves, nozzles, associated passages, hoses, and the like and cleansing the interior and exterior of the atomizing cup is accomplished in accordance with procedures well known in the art, and therefore are not further discussed herein.

A source of pressurized solvent 180 feeds a hose 182 which is bifurcated to supply the hose 174 which provides solvent to the valve 90 for controlling the flow of solvent for cleaning the exterior of the cup 20 and to supply a hose 175 which supplies solvent to the valve 92 which controls the flow of cleansing solvent to the interior cavity 34 of the atomizing cup 20.

A source of pressurized air 185 connects to hoses 186 and 188 which are input to the air turbine 31 for driving and braking the turbine rotor, respectively, and in turn, driving and braking, respectively, the shaft 23 and ultimately the atomizing cup 20. A hose 190 vents exhaust air from the turbine 31. By selectively controlling the pressure and flow of air in hoses 186 and 188, the speed of the air turbine 31, and hence of the output shaft 23 and ultimately the rotary atomizing cup 20, can be controlled in a manner well known to those skilled in the art.

An air hose 192 connected to a selectively operable source of pressurized air controls the solvent valve 92 for cleansing the interior of the rotary atomizing cup 20. Air hose 192 functions with respect to solvent valve 92 in a manner analogous to air hose 176 which is connected to solvent valve 90 for controlling its operation and air hose 138 which connects to the paint valve 33 for controlling its operation.

To minimize the accumulation of coating material on the surface of the shaft 23, air purge means are provided to supply a positive air flow along the shaft toward the rotary atomizing member 20. In a preferred form the air purge means includes, as shown in FIG. 2, a port 300 provided in the back wall 12*a* of the forward body section 12 for connection to an air supply line (not shown). The air line will supply air through a passage 302 to a discharge port 304 into the space 308 between the bore 12*b* of the forward body support section 12 and the shaft 23. This air supplies a positive air purge along the shaft 23 towards the cup 20 to prevent coating from migrating back along the shaft into the bearing 25.

High voltage electrostatic energy is coupled from the electrode 78 at the output of the gun resistor 76 to the semiconductive ring 102 (and ultimately to the semiconductive electrode 46 via the semiconductive pins 104) via a path which includes an electrically conductive spring contact 200 located in the forward end of the bore 72 formed in the forward body section 12, an electrical conductor 202 snugly fitting in a bore formed in the forward body section, an electrode ring 204 imbedded in an annular recess formed in the rear wall 206 of the annular ring 24, and several parallel circuit paths connected between the ring conductor 204 and the semiconductive ring 102. The series circuit paths between rings 204 and 102 include a resistor 210 disposed between (a) an electrical conductor 212 which is connected between the resistor 210 and the ring 204 and (b) a conductor 214 extending from the forward end of the resistor 210 toward and in close proximity to the semiconductive ring 102. An insulative sheath 216 threaded at its inner or rear end into a suitably threaded bore in the annular ring 24 encases the resistor 210, conductor 212, and conductor 214, with conductor 214 projecting from the forward end of the sheath. Insulative sheaths 218 and 220, identical to sheath 216, mounted in circumferentially spaced relation around the annular ring 24 120° on either side of the sheath 216, contain resistors 218*a* (FIG. 3) and 220*a* which are identical to resistor 210. Resistor 218*a* is connected between (a) an outer electrical conductor 218*b* which extends from the forward end of its associated sheath toward and in close proximity to the semiconductive ring 102 and (b) an electrical conductor 218*c* which is connected to the conductive ring 204 for transmitting electrostatic voltage to the resistor 218*a*. Resistor 220*a* is connected between (a) an electrical conductor 220*b* which extends from the forward end of its associated sheath toward and in close proximity to the semiconductive ring 102 and (b) an electrical conductor 220*c* which is connected between the resistor and the electrically conductive ring 204. The forwardly projecting ends of the electrical conductors 214, 218*b*, and 220*b* are spaced very slightly from the exterior surface of the semiconductive ring 102 such that when high voltage is transmitted thereto via the insulated cable 74, gun resistor 76, conductor 78, spring 200, conductor 202, ring conductor 204, and conductor/resistor pairs 210/212, 218*a*/218*c*, and 220*a*/220*c*, electrostatic energy is transmitted across the gap to the semiconductive ring 102 and ultimately to the ring electrode 46 via pins 104 for contact charging of liquid coating material which flows radially outwardly and forwardly along inner wall 40 over the surface of the semiconductive electrode 46.

It has been discovered that the coating transfer efficiency is enhanced by the use of three circumferentially-spaced conductors 212, 218*c* and 220*c* in comparison to that achieved when only a single conductor is used. Thus, plural conductors provide improved results and are clearly preferred where high transfer efficiency is desired.

Gun resistor 76 can have a resistance which varies depending upon the operating range of the electrostatic power supply which energizes the cable 74. Preferably, for electrostatic supplies operating in the range of 50Kv–125Kv, the gun resistor has a resistance of 75 megohms. The resistors 210, 218*a*, and 220*a* can also have varying resistances, although preferably each such resistor has a resistance of approximately 12 megohms.

The insulated cable 74 may take a variety of forms, although the preferred cable is one in which the conductive core 74*b* is fabricated of silicon carbide fiber in accordance with the disclosure and claims of Hastings et al U.S. Pat. No. 4,576,827, granted Mar. 18, 1986, assigned to the assignee of the present application, the entire disclosure of which is incorporated herein by reference. The semiconductive ring 102, pins 104, and electrode 46 are also preferably fabricated of RYTON (polyphenylene sulfide (PPS)), available from Phillips 66, although other semiconductive materials may be used. In addition, and although not preferred, the ring 102, pins 104, and/or electrode 46 can be fabricated of conductive material. However, when fabricated of conductive material, the capability of the rotating atomizing cup 20 to capacitively store electrical energy is increased over that which exists when the ring 102, pins 104, and electrode 46 are fabricated of semiconductive material. If desired, the conductive elements 78, 200, 202, 204, 212, 214, 218*b* and 218*c*, and 220*b* and 220*c* can be fabricated of semiconductive material rather than conductive material. Accordingly, and for the purpose of minimizing the electrical energy stored capacitively in the spray device of this invention, all elements of the spray device are preferably fabricated of insulative material, except for those which are fabricated of semiconductive and/or electrically conductive material for the purpose of transporting electrostatic energy at high voltage from a remote source (not shown) to the coating charging electrode 46 in the rotary atomizing cup 20.

In the preferred embodiment, the rotating atomizing cup 20 has been described as being frusto-conical in shape. As those skilled in the art will understand, other shapes can be utilized without departing from the spirit and scope of this invention.

The valves 33, 80, 90, and 92 are generally constructed in accordance with the teachings of Hastings et al U.S. Pat. No. 3,870,233, assigned to the assignee of this application, the disclosure of which is incorporated herein by reference.

ALTERNATE EMBODIMENT

Figure 10:
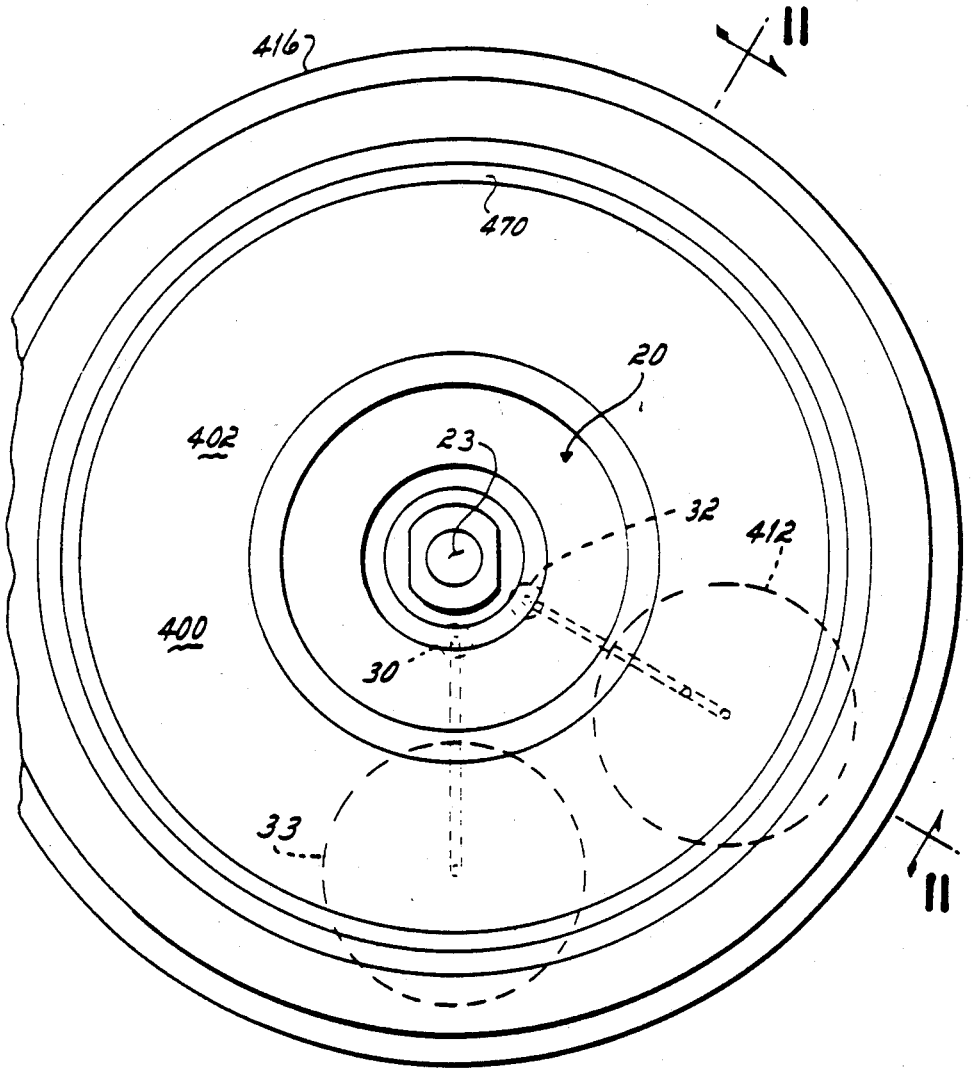
FIG. 10 is a front view of an alternate embodiment of the discharge nozzle of a rotary atomizing spray coating apparatus.
Figure 11:
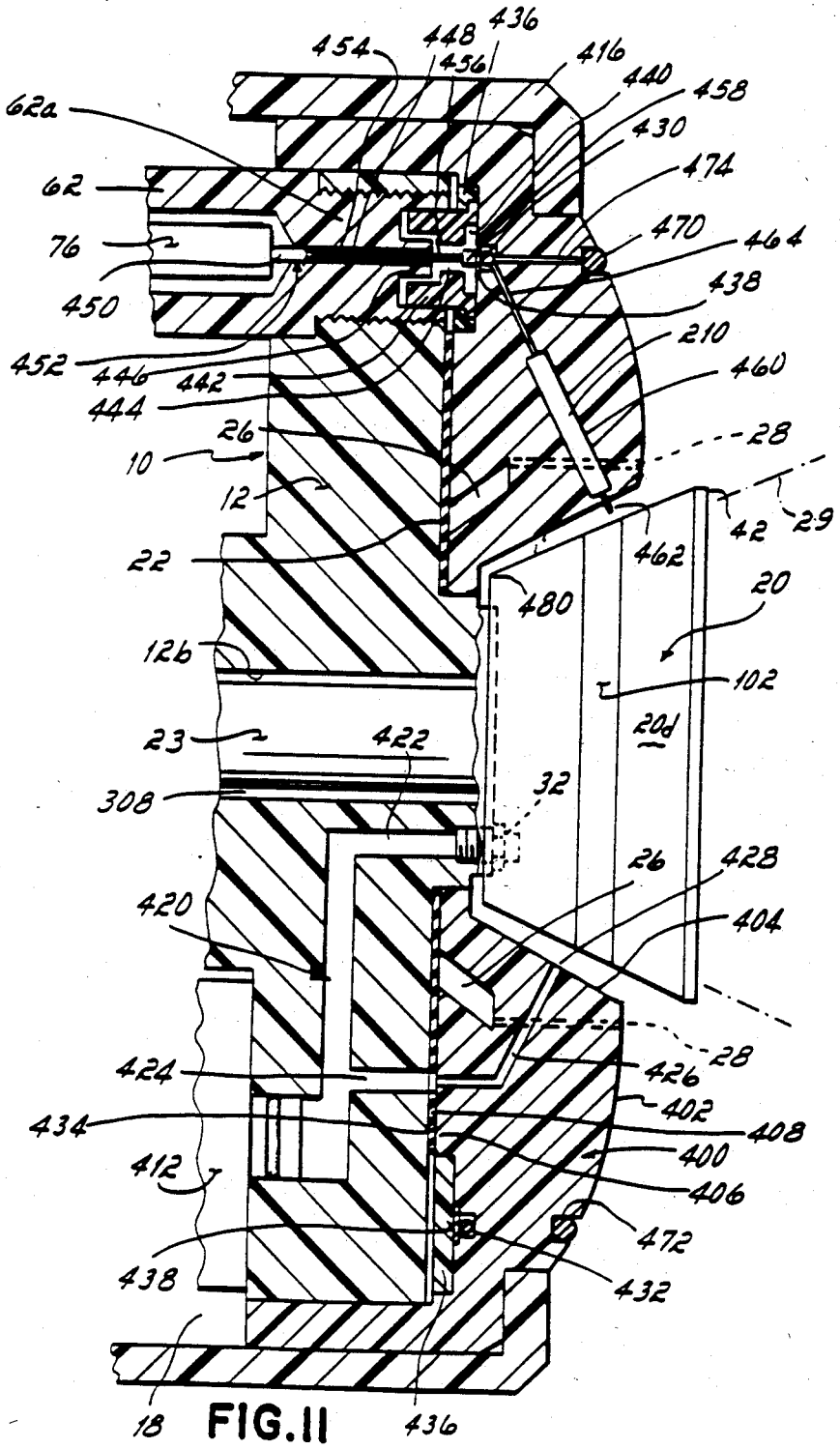
FIG. 11 is a partial cross-sectional view taken on line 11—11 of FIG. 10.

Other aspects of the present invention will now be described with reference to the alternate embodiment shown in FIGS. 10 and 11 to which we now refer. Except for the differences to be described, the alternate embodiment is substantially the same as the first embodiment discussed above, with like parts having been assigned like reference numerals.

The alternate embodiment of the rotary atomizing liquid spray coating device of this invention is seen to include a support body 10 having a front or forward section 12. As with the first embodiment, an annular cavity 18 is located rearwardly of the forward section 12. Within cavity 18 are located, as will be described in more detail hereafter, various valves for controlling the flow of liquid coating material and solvent for cleansing the interior and exterior of the rotary atomizing cup 20.

Rotary atomizing cup 20 extends forwardly from the front surface 22 of the forward body section 12. Removably secured to the front surface 22 of the forward section 12 of the body 10 in any suitable manner, such as by bolts, threaded engagement, or the like, is a cap 400 having a generally convex outer face 402 and a centrally disposed, inwardly tapering recess 404 inside which, at least a portion of atomizing cup 20 may be located. Cap 400 includes a base 406 having a generally circular air passage or manifold 26 formed therein. A gasket 408 having suitably sized and positioned apertures is interposed between cap 400 and the front surface 22 of the forward section 12 of body 10 to provide a suitable seal for air and solvent passages, to be described later, which communicate between forward section 12 and cap 400. Similar to the annular ring 24 of the first embodiment, cap 400 includes a plurality of circularly arranged air ports 28 for establishing a circular array of air jets surrounding rotary atomizing cup 20 for shaping the atomized liquid coating spray pattern 29 formed at the forward edge or rim 42 of the atomizing cup 20 and projecting it toward a workpiece to be coated in the manner previously described.

As noted, extending forwardly from the forward section 12 of the body 10 is the rotary atomizing cup 20. Cup 20 is drivingly mounted for rotation on a shaft 23 of a rotary actuator (not shown) The cup drive shaft 23 extends through a bore 12*b* in forward body section 12. As in the first embodiment, a liquid coating control valve 33 is mounted to the rear surface of the forward section 12 and controls the flow of liquid coating material to the coating nozzle 30. Liquid coating under slight pressure exiting nozzle 30 enters the cup 20 and passes therethrough there as previously described with reference to the first embodiment.

Mounted within cavity 18 and on the rear surface of the forward body section 12, in addition to the coating control valve 33, is a single solvent valve 412 which, in lieu of the dual interior and exterior solvent valves 90, 92 of the first embodiment. Valve 412 controls the flow of solvent, in a manner to be described, to both the interior and exterior of the rotary atomizing cup 20.

The diameter of frusto-conical rotary atomizing cup 20 increases along the axis of the cup in the direction of the atomizing edge 42. Imbedded in the outer surface 20*d* of the frusto-conical cup 20 is a circular current-conducting flat ring element 102, preferably of semiconductive material. According to one aspect of the invention, ring element 102 is recessed substantially entirely within the recess 404 in which cup 20 is disposed thereby decreasing the likelihood that personnel or objects can contact element 102 creating a shock hazard. As with the first embodiment, ring element 102 is electrically connected to the charging flat electrode located on the interior surface of cup 20 in the manner previously described. A housing 416 is used to enclose all the operating components and the various conduits for coating material solvent and waste as well as the high voltage electrical cable are preferably routed rearwardly through appropriate apertures (not shown) in the rear mounting bracket rather than through the side walls as shown in FIG. 1. This locates the conduits and cable as far as possible from the spray pattern 29 emanating from the edge of atomizing cup 20 to help prevent the accumulation of coating material on them. It also provides a sleek, attractive uncluttered appearance.

When it is desired to change the color of the liquid coating material being sprayed from the device of this invention, coating valve 33 is flushed with solvent by way of dump valve in the manner previously described. According to the alternate embodiment of the invention, interior and exterior cleansing of atomizer cup 20 of liquid coating material with solvent as an incident to color change is performed using single solvent valve 412. To this end, valve 412 communicates with a bore 420 in body section 12. The bore 420 has a pair of branch bores 422, 424. Branch bore 422 connects with nozzle 32 to cleanse the interior of cup 20 in the manner previously described. The other branch bore 424, exits through a suitable aperture in gasket 408 and connects with a bore 426 in cap 400. This bore 426 has an exit port 428 at the wall of inwardly tapering recess 404 directed to cleanse the exterior 20*d* of cup 20. Valve 412 is constructed substantially identically to dump valve 30 as previously described and is actuated by a controlled source of pressurized air to simultaneously flush the interior and exterior of cup 20 with solvent prior to a color change or for periodic cleaning.

In the first embodiment, purge air was provided to minimize the accumulation of coating material on the surface of the shaft 23. According to the alternate embodiment, bearing 25 is selected to be an air bearing. This eliminates a separate purging air passage such as passage 302 previously described with reference to the first embodiment, since the normal air leakage of the air bearing (not shown) to flow along shaft 23 as a air purge means in the space 308. This flow of leakage air supplies a positive air purge along the shaft 23 towards the cup 20 to prevent coating from migrating back along the shaft into the bearing (not shown).

The path for conducting high voltage electrostatic energy from gun resistor 76 to the charging electrode 102 imbedded in the interior wall 20*d* of atomizing cup 20 according to the alternate embodiment will now be described in further detail. An annular conductor 430 which substantially encircles cap 400 is disposed in an annular stepped groove 432 cut in base or rear face 434 of cap 400. Conductor 430 is captured within groove 432 by an insulating ring 436 which is sealed in the larger step of groove 432 using a suitable adhesive sealant such as an epoxy. The conductor 430 is connected by soldering, brazing or other suitable means to a conductive disk 438, which is preferably of brass or other electrically conductive corrosion resistant material. Disk 438 nests within a recess 440 of an electrically insulating bushing 442 which, in turn nests partially inside the front end 62*a* of the support column 62 which houses gun resistor 76. The opposite end of bushing 442 nests in a pocket in the ring 436. Bushing 442 includes an axial bore 444 which receives a cylindrical projecting portion 446 of column 62. Column end 62*a* and projection 446 include a bore 448 which communicates with gun resistor 76. Received within bore 448 is the hollow tubular body portion 450 of electrically conductive spring contact assembly 452. Body portion 448 contains a spring 454 which is compressively biased by a plunger 456 having a head 458 which abuts disk 438 as the base of body portion 450 abuts gun resistor 76 thereby providing good electrical contact between gun resistor 76 and disk 438 which is in turn connected to annular conductor 430.

Electrostatic energy is transferred from conductor 430 to charging electrode 102 by way of three charging resistors 210 of identical nominal resistance connected electrically in parallel between charging electrode 102 and conductor 430. According to the alternate embodiment, the charging resistors 210 are physically mounted within cap 400 in evenly circumferentially spaced relation to one another. Resistors 210 all fit snugly within bores 460 which communicate with conductor 430, and which are disposed with the recess 404 of cap 400 wherein atomizer cup 20 is located. Bores 460 each intersect recess 404 at a location opposite the ring element 102 of atomizer cup 20 so that the free ends 462 of the charging resistors act as electrodes which terminate in closely spaced proximity to semi-conductive ring element 102. By imbedding charging resistors 210 within cap 400 the invention affords substantial protection against their being damaged or misaligned due accidental impact. Also, since the electrode leads 462 are located within recess 404 there is less likelihood they can be contacted by personnel or objects thereby reducing the risk of electrical shock or mechanical damage. The opposite leads 464 of the charging resistors 210 pass through reduced diameter portions of bores 460 which intersect groove 432, at which point leads 464 are connected to conductor 430 by soldering or other suitable means.

Thus, high voltage electrostatic energy is transmitted by way of high voltage cable 74 as previously described to gun resistor 76. It is then carried to conductor 430 by way of spring contact 452 and disk 438. From conductor 430, electrostatic energy is carried to charging electrode 102 of atomizing cup 20 by way of the three charging resistors 210 connected electrically in parallel between conductor 430 and the gap between the electrodes or free ends 462 of said resistors and the ring element 102 on the outside of atomizing cup 20. Electrostatic energy is then transmitted across the gap between each said electrodes 462 and semi-conductive ring element 102. From ring element 102, the electrostatic energy is utilized in the manner of the first embodiment to impart a charge to the coating material.

The resistances of gun resistor 76 and charging resistors 210 are selected as previously described. As with the embodiments previously described, and for the purpose of minimizing the electrical energy stored capacitively in the spray device of this invention, all elements of the spray device are preferably fabricated of insulative material, except for those which are fabricated of semi-conductive and/or electrically conductive material for the purpose of transporting electrostatic energy at high voltage from a remote source (not shown) to the coating charging electrode 102 in the rotary atomizing cup 20.

The alternate embodiment of the rotary atomizing liquid spray system of the invention includes several features which help to project the spray pattern 29 forwardly toward the work piece to be coated and avoid the accumulation of coating material on the sprayer itself thereby increasing transfer efficiency and decreasing fouling of the sprayer. One such feature, namely the provision of a plurality of air ports 28 for establishing an array of forwardly directed air jets surrounding atomizing cup 20 for shaping and projecting spray pattern 29 toward the workpiece to be coated has already been described. Further according to the invention, the sprayer of this embodiment also preferably includes at least one of the additional features which will now be described.

Atomizer cup 20 is surrounded by electrostatic repulsion means which preferably takes the form of a substantially continuous conductive, or more preferably, semi-conductive ring 470. Ring 470 is imbedded in a groove 472 cut in the outer face 402 of cap 400 as to lie substantially flush therewith as not to interfere significantly with its contour for reasons which will later become apparent. Ring 470 is electrically connected directly to conductor 430 by way of a conductive pin 474 so that ring 470 is energized with a high voltage charge of the same polarity as the charge carried by the coating droplets. This helps to promote the migration of spray pattern away from the spray apparatus and toward the workpiece to be coated.

Another important aspect of the present invention which has been found to help increase transfer efficiency by avoiding air flow eddys which tend to inhibit the forward migration of spray pattern 29 and to be useful in avoiding the accumulation of coating material on the spray apparatus is the provision of a curved, aerodynamically contoured outer face 402 on cap 400 as shown. The forward portion of cap 400 defines a circular dome having a contoured outer face 402 and a central recess 404 in which frusto-conical atomizing cup 20 is recessed. For the purpose of avoiding reverse air flow eddys, the degree to which cup 20 is recessed within cap 400 is not believed to be critical. In fact, recess 404 may be eliminated so that outer face 402 lies substantially entirely behind cup 20. However, so that conductive ring 102 and electrodes 462 may be protected as previously described, cup 20 is preferably recessed within cap 400 from to approximately one-half to two-thirds of its overall length. Recess 404 tapers inwardly at a slightly greater rate than the wall of cup 20 so that the gap between cup 20 and recess 404 is slightly narrower at its base than at is mouth. The transition edge between tapered recess 404 and curved outer face 402 is not sharp but rather is provided with a generous radius as shown in the drawings. This aspect of the invention will become further apparent in light of its theory of operation which is believed to be as follows.

As atomizer cup 20 rotates at an angular speed sufficient to atomize coating material, usually in the range of 10,000 to 40,000 R.P.M., its atomizing edge 42, which is a larger diameter than its base 480, rotates at a greater surface speed than its base. Since the air surrounding cup 20 will tend to move with the surface of the cup 20 due to drag, there will be a pressure gradient along the outside wall **20*d* of cup 20 tending to cause a flow of air along the outside wall 20*d* in a direction generally parallel to wall 20*d* and oriented from base 480 toward edge 42. Since the aforementioned air flow would tend to partially evacuate the region near the base of the cup, it is believed that a make-up air flow takes place along outer face 20*d* inwardly toward the base 480 of cup 20 along the wall of recess 404. The shape of cap 400, particularly the shape of its outer face 402 is selected such that under conditions of normal operation, the flow of make-up air across its surface will be in a substantially laminar flow regime. This is believed to help avoid the generation of eddy currents in the vicinity of cup 20** which would otherwise tend to draw coating material back toward the spray apparatus rather than permit it to be directed toward the workpiece as desired.

FURTHER ALTERNATIVE EMBODIMENTS

Figure 12:
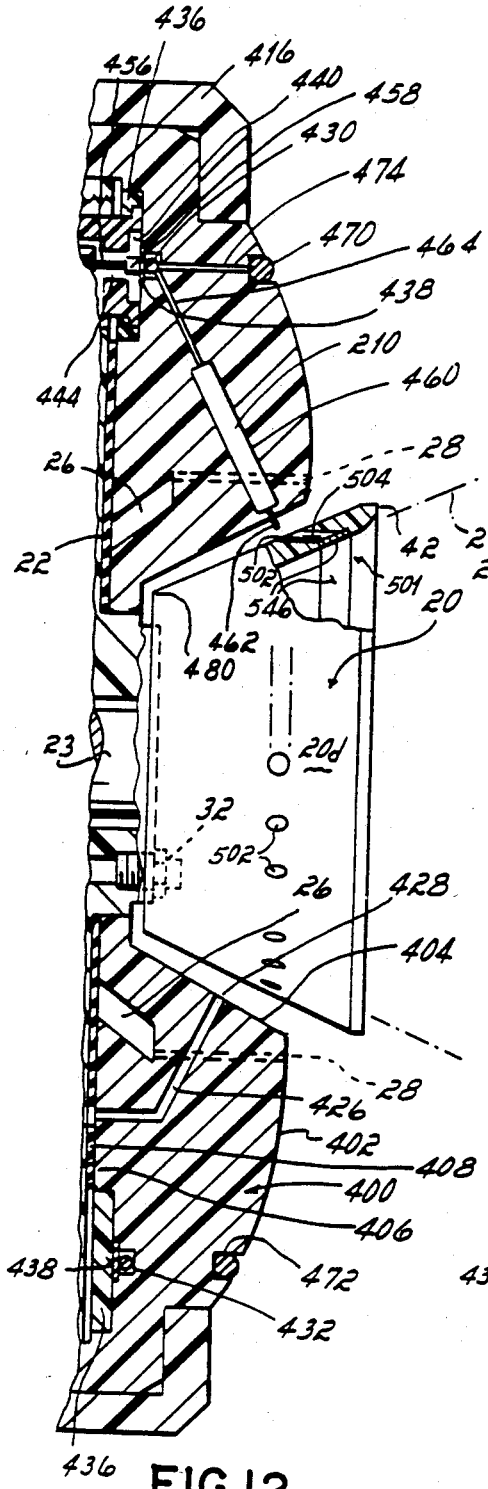
FIG. 12 is a cross-sectional view similar in format to FIG. 11 of a portion of a further alternative embodiment of the charging mans of the rotary atomizer of the device of FIG. 1.
Figure 13:
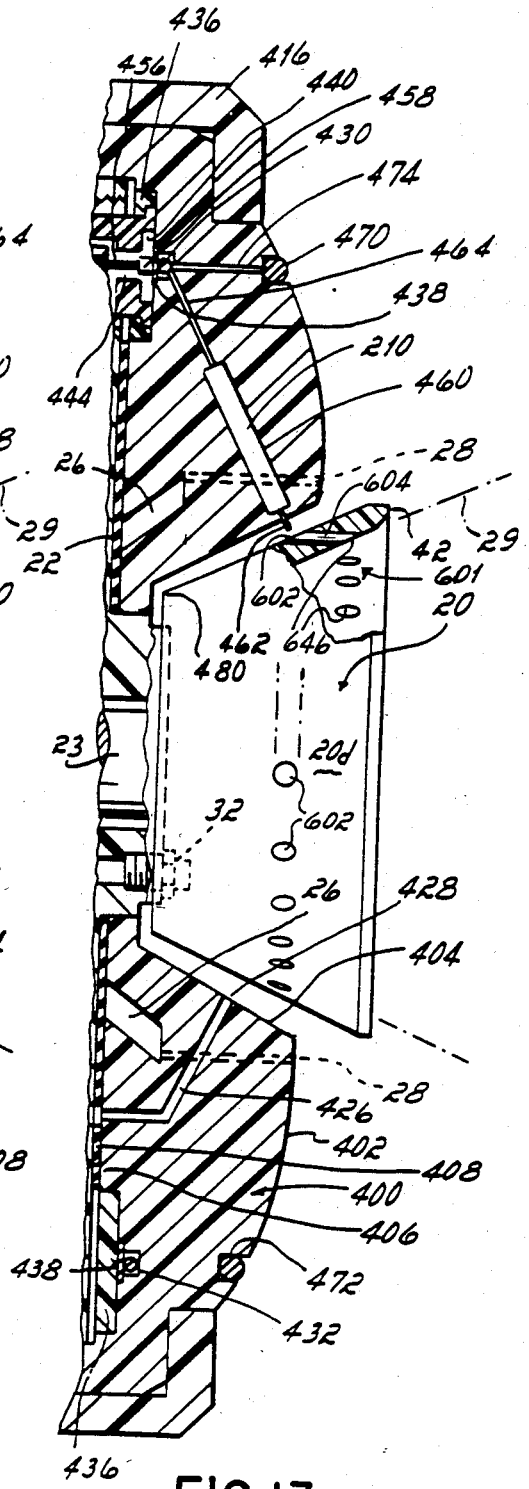
FIG. 13 is a view similar to FIG. 12 illustrating a further alternative embodiment of the charging means of the atomizer of FIG. 1.

Alternative embodiments of the invention are shown in FIGS. 12 and 13. Except for the differences described, these embodiments are substantially the same as those discussed above, with like parts assigned like reference numerals. The charging means heretofore described with rings 46 and 102, respectively, forming the inner and outer portions thereof with pins 104 forming the connection therebetween is formed differently in FIGS. 12 and 13.

Referring to FIG. 12, the outer portion of charging means 501 of cup 20, rather than being in the form of the circular flat ring element 102 (FIG. 2), is formed by the outer ends 502, proximate the outer surface **20*d* of the cup 20, of a plurality of discrete posts 504 circumferentially spaced about the axis of the atomizer cup 20, preferably at equal angular increments. The pins 504, and their ends 502, are preferably eight or more in number, and preferably, sixteen. As such, the ends 502 of the posts 504 function in the same way as the circular ring element 102 of FIGS. 1–11. The inner portion of the charging means 501 is in the form of the ring 546 configured and positioned in the same manner as the ring 46 of FIGS. 1–11**.

Referring to FIG. 13, the charging means 601 rather than in the form of a circular ring 46 as in the embodiments above, is in the form of a plurality of discrete circumferentially spaced charging electrodes 604 extending between the inner and outer surfaces of the atomizer 20, and preferably spaced at equal angular increments about the atomizer axis of rotation. The inner portion of the charging means 601 is formed of the inner ends 646 of the electrodes 604 which are proximate to the inner surface of the atomizer 20. The outer portion of the charging means is formed of the outer ends 602 of the electrodes 604 which are proximate the outer surface of the atomizer 20. The electrodes 604 are preferably number at least eight, and preferably about sixteen. The electrodes inner ends 646 function in the same manner and nearly as effectively in charging the liquid as the charging electrode ring 46 in the other embodiments, but hold less residual charge with improved safety.

What is claimed is:

1. Electrostatic rotary atomizing liquid spray coating apparatus comprising:

a support body of insulative material having forward, intermediate, and rear sections, a rotary atomizer of insulative material having an axis of rotation, a first surface over which liquid coating can flow outwardly to an atomizing edge thereof when said atomizer is rotated about said axis of rotation, and a second surface separated from said first surface by said atomizing edge, a circular ring-shaped charging electrode mounted on said first surface encircling said axis of rotation, a circular electrical current-conducting element mounted on said second surface encircling said axis of rotation, means mounted to said rotary atomizer for electrically connecting said circular electrode and said electrical current-conducting element, drive means incorporated in said support body drivingly mounting said rotary atomizer to said forward section of said support body for rotating said rotary atomizer about said axis of rotation, means fabricated of insulative material for supplying liquid coating to said first surface of said rotary atomizer when said atomizer is rotating about its rotational axis, and plural circumferentially-spaced electrical conductors stationarily mounted to said forward section of said support body, said conductors having a free end located in closely spaced proximity to said circular electrical current-conducting element for transferring electrostatic energy thereto when said stationary electrical conductors are energized from a high voltage source for facilitating contact charging of liquid coating supplied to said first surface when said coating flows outwardly over said first surface in contact with said charging electrode toward said atomizing edge.

2. The apparatus of claim 1 wherein said circular electrode is semi-conductive.

3. The apparatus of claim 2 wherein said electrical current-conducting element and said electrical connecting means are semiconductive.

4. The apparatus of claim 1 further including first and second solvent spray nozzles stationarily mounted to said forward section of said support body proximate said first and second surfaces, respectively, for directing solvent thereat to cleanse said surfaces, solvent valve means mounted proximate said forward section of said support body, and solvent conduit means interconnecting said solvent valve means and said solvent nozzles for transporting solvent to said solvent nozzles under control of said solvent valve means to cleanse said first and second surfaces.

5. The apparatus of claim 4 wherein said liquid coating supply means includes a liquid coating nozzle mounted on said forward section of said support body in proximity to said rotary atomizer, a liquid coating valve mounted proximate said forward section of said support body, and a liquid coating conduit interconnecting said liquid coating valve and said liquid coating nozzle for transporting liquid coating to said liquid coating nozzle under control of said liquid coating valve.

6. The apparatus of claim 5 wherein said drive means includes an air turbine mounted to said rear section of said support body, a drive shaft interconnecting said turbine and said rotary atomizer, and an air bearing mounted to said intermediate section of said support body, said liquid coating valve and solvent valve means are located radially outwardly of said bearing.

7. The apparatus of claim 6 further comprising a mounting bracket, and insulative column means fixedly interconnecting said bracket and said support body for mounting said bracket and rear section of said support body in spaced apart relation to establish a space therebetween.

8. The apparatus of claim 7 further comprising a dump valve mounted in said space between said bracket and said rear section of said support body, and conduit means interconnected between said dump valve and said liquid coating valve.

9. The apparatus of claim 8 further comprising a tubular housing extending between said bracket and forward section of said support body for enclosing said dump valve, liquid coating valve and solvent valve means and said conduit interconnecting said dump valve and said liquid coating valve.

10. The apparatus of claim 6 wherein said rear section of said support body includes a turbine cavity within which is located said turbine, said intermediate section of said support body includes a bearing cavity within which said bearing is located and said forward section of said support body includes a bore through which said shaft extends, whereby said support body substantially encases said turbine, bearing and shaft.

11. The apparatus of claim 10 wherein said forward section of said support body includes a flange extending radially outwardly of said intermediate body section to define a rear-facing surface, and wherein said liquid coating valve and said solvent valve means are mounted to said rear-facing surface of said flange adjacent said intermediate body section.

12. The apparatus of claim 7 wherein said column means includes at least two spaced-apart columns, with one of said columns having an axial bore along its length for housing an electrostatic energyconducting core for transporting high voltage electrostatic energy between said stationary conductor which is in closely spaced proximity to said circular electrical current-conducting element and a high voltage source located remote therefrom.

13. The apparatus of claim 12 further including a gun resistor located in said axial bore of said one column in series circuit with said circular electrical current-conducting element.

14. The apparatus of claim 1 wherein said liquid coating supply means includes a liquid coating nozzle mounted on said forward section of said support body in proximity to said rotary atomizer, a liquid coating valve mounted proximate said forward section of said support body, and a liquid coating conduit interconnecting said liquid coating valve and said liquid coating nozzle for transporting liquid coating to said liquid coating nozzle under control of said liquid coating valve.

15. The apparatus of claim 1 wherein said rotary atomizer includes a tubular section having an inner surface which includes said first surface and an outer surface which includes aid second surface, said tubular section terminating forwardly at said atomizing edge and having a nonuniform cross section which increases in the direction of said atomizing edge, and wherein said electrical connecting means extends radially through said tubular section.

16. The apparatus of claim 1 comprising at least three said electrical conductors stationarily mounted to said forward section of said body support at substantially equally spaced circumferential intervals, each said conductor having a free end located in closely spaced proximity to said circular electrical current-conducting element for transferring electrostatic energy thereto when energized from a high voltage source.

17. The apparatus of claim 16 further including separate insulative sleeves having forward and rear ends encasing each of said three electrical conductors, with the free ends of said electrical conductors projecting from the forward ends of their respectively associated insulative sleeve, separate resistors encased within each of said sleeves in series circuit with their respectively associated electrical conductors, said rear ends of said sleeves each being mounted to said forward section of said support body at circumferentially spaced locations.

18. Electrostatic rotary atomizing liquid spray coating apparatus of claim 1 wherein:

said support body is generally cylindrically shaped having said forward and rear sections disposed on opposite sides of said intermediate section, said intermediate section having a diameter substantially less than that of said forward and rear body sections to define an annular cavity therebetween, said apparatus further comprising:

drive means for rotating said rotary atomizer about its axis of rotation, said drive means including (a) an air turbine located within a cavity in said rear body support section, (b) a drive shaft connected between said turbine and said rotary atomizer and extending through a bore in said forward body support section, and (c) a bearing located in a cavity in said intermediate body support section for rotatably supporting said shaft, means for supplying liquid coating to said surface of said rotary atomizer when said atomizer is rotating about its rotational axis, said means including (a) a liquid coating valve mounted in said annular cavity proximate said forward section of said body, and (b) a liquid coating nozzle mounted on said forward body support section in proximity to said surface of said rotary atomizer, and (c) a liquid coating conduit interconnecting said liquid coating valve and said liquid coating nozzle for transporting liquid coating to said liquid coating nozzle under control of said liquid coating valve, and an electrical conductor stationarily mounted to said forward body support section, said conductor having a free end located in closely spaced proximity to said circular conducting element for transferring electrostatic energy thereto when said stationary electrical conductor is energized from a high voltage source for facilitating charging of liquid coating supplied to said surface of said rotary atomizer when said coating flows outwardly over said surface in charging relationship with said charging means toward said atomizing edge under centrifugal force produced by rotation of said rotary atomizer.

19. The apparatus of claim 18 further including a solvent spray nozzle stationarily mounted to said forward section of said support body proximate said surface of said rotary atomizer for directing solvent thereat to cleanse said surface, a solvent valve mounted in said annular cavity proximate said forward section of said support body, and solvent conduit means interconnecting said solvent valve and said solvent nozzle for transporting solvent to said solvent nozzle under control of said solvent valve to cleanse said surface of said rotary atomizer.

20. The apparatus of claim 19 wherein said solvent and liquid coating valves are fabricated substantially of insulative material.

21. The apparatus of claim 1, further comprising, a cap on the forward section of said support body generally surrounding said rotary atomizer, said cap having an outer face whose shape is adapted to provide a substantially laminar flow of air thereacross as said rotary atomizer rotates about said rotational axis during normal operation.

22. The apparatus of claim 21 wherein said cap includes a recess in which said rotary atomizer is at least partially disposed to define a gap between said cap and said second surface of said rotary atomizer, said free ends of said conductors and said circular current conducting element each being disposed substantially within said gap whereby said free ends and said element are afforded substantial protection against inadvertent contact.

23. The apparatus of claim 21, further comprising, an array of air passages surrounding said rotary atomizer, and means for supplying air under pressure to said passages to establish an array of air jets for projecting and shaping a pattern of atomized liquid coating material.

24. The apparatus of claim 1, further comprising, electrostatic repulsion means affixed to said apparatus to repel charged, atomized liquid coating therefrom.

25. The apparatus of claim 1, further comprising, a cap on the forward section of said support body generally surrounding said rotary atomizer, said cap having an outer face whose shape is adapted to provide a substantially laminar flow of air thereacross as said rotary atomizer rotates about said rotational axis during normal operation;

an array of air passages in said cap surrounding said rotary atomizer;

means for supplying air under pressure to said passages to establish an array of air jets for projecting and shaping a pattern of liquid coating material atomized by said rotary atomizer, and a repulsion ring on said cap to electrostatically repel charged liquid coating material atomized by said rotary atomizers.

26. Electrostatic rotary atomizing liquid spray coating apparatus comprising:

a generally cylindrically shaped support body having forward and rear sections disposed on opposite sides of an intermediate section, said intermediate section having a diameter substantially less than that of said forward and rear body sections to define an annular cavity therebetween, a frusto-conically shaped tubular rotary atomizer of insulative material having an inner surface and an outer surface extending between a rear edge and a forward atomizing edge, with the diameter of the forward edge exceeding the diameter of the rear edge, said atomizer having an axis of rotation, a circular charging electrode mounted on said inner surface encircling said axis of rotation, a circular current-conducting element mounted on said outer surface encircling said axis of rotation, means mounted to said rotary atomizer for electrically connecting said circular electrode and said circular element, drive means for rotating said rotary atomizer about its axis of rotation, said drive means including (a) an air turbine located within a cavity in said rear body support section, (b) a drive shaft connected between said turbine and said rotary atomizer and extending through a bore in said forward body support section, and (c) an air bearing located in a cavity in said intermediate body support section for rotatably supporting said shaft, means for supplying liquid coating to said inner surface of said rotary atomizer when said atomizer is rotating about its rotational axis, said means including (a) a liquid coating valve mounted in said annular cavity proximate said forward section of said support body, and (b) a liquid coating nozzle mounted on said forward body support section in proximity to said inner surface of said rotary atomizer, and (c) a liquid coating conduit interconnecting said liquid coating valve and said liquid coating nozzle for transporting liquid coating to said liquid coating nozzle under control of said liquid coating valve, plural electrical conductors stationarily mounted to said forward body support section at circumferentially spaced intervals, each said conductor having a free end located in closely spaced proximity to said circular conducting element for transferring electrostatic energy thereto when said stationary electrical conductors are energized from a high voltage source for facilitating contact charging of liquid coating supplied to said inner surface of said rotary atomizer when said coating flows forwardly and outwardly over said inner surface in contact with said charging electrode toward said atomizing edge under centrifugal force produced by rotation of said rotary atomizer.

27. The apparatus of claim 25 wherein said circular electrode and circular element are semiconductive.

28. Electrostatic rotary atomizing liquid spray coating apparatus comprising:

a support body of insulative material having forward, intermediate, and rear sections, said forward section having a front surface, a rotary atomizer of insulative material having an axis of rotation, and a surface over which liquid coating can flow outwardly to an atomizing edge thereof when said atomizer is rotated about said axis of rotation, said rotary atomizer including means for charging liquid coating material, drive means incorporated in said support body drivingly mounting said rotary atomizer to said forward section of said support body for rotating said rotary atomizer about said axis of rotation, means fabricated of insulative material for supplying liquid coating to said surface of said rotary atomizer when said atomizer is rotating about its rotational axis, an annular ring detachably mounted to said forward section of said support body and having a rear surface in contact with said front surface of said forward section of said support body and a front surface provided with a circular array of air passages, said rear surface of said annular ring having a first annular recess communicating with said circular array of air passages for supplying air thereto to establish a circular array of air jets for shaping the pattern of atomized liquid coating, said rear surface of said annular ring having a second annular recess, a circular conductor mounted in said second annular recess, and plural circumferentially-spaced electrical conductors stationarily mounted to said annular air ring, said conductors each having a rear end connected to said circular conductor and a forward free end located in closely spaced proximity to said rotary atomizer charging means for transferring electrostatic energy thereto when said stationary electrical conductors are energized from a high voltage source connected to said circular conductor for facilitating charging of liquid coating supplied to said rotary atomizer surface when said coating flows outwardly over said surface toward said atomizing edge in charging relationship to said rotary atomizer charging means.

29. The apparatus of claim 28 further comprising:

plural insulative sheaths respectively encasing said plural electrical conductors, each said sheath having a rear end detachably secured to said air ring from which the rear end of its respectively associated conductor extends and a forward end from which the forward end of its respectively associated conductor projects.

30. The apparatus of claim 29 wherein said air ring includes plural threaded bores extending between said front surface and second annular recess of said air ring, and wherein said rear ends of said sheaths are threadedly secured in said threaded bores of said air ring with the rear ends of said conductors electrically connected to said circular conductor in said second annular recess of said air ring.

31. Electrostatic rotary atomizing liquid spray coating apparatus comprising:

a support body of insulative material having forward, intermediate, and rear sections;

a čap on the forward section of said support body, said cap having a recess;

a rotary atomizer of insulative material having an axis of rotation, a first surface over which liquid coating can flow outwardly to an atomizing edge thereof when said atomizer is rotated about said axis of rotation, and a second surface separated from said first surface by said atomizing edge, said rotary atomizer being at least partially disposed within said recess to define a gap between said cap and said second surface;

a circular ring-shaped charging electrode mounted on said first surface encircling said axis of rotation;

a circular electrical current-conducting element mounted on said second surface encircling said axis of rotation;

means mounted to said rotary atomizer for electrically connecting said circular electrode and said electrical current-conducting element;

drive means incorporated in said support body drivingly mounting said rotary atomizer to said forward section of said support body for rotating said rotary atomizer about said axis of rotation;

means fabricated substantially of insulative material for supplying liquid coating to said first surface of said rotary atomizer when said atomizer is rotating about its rotational axis, and plural circumferentially-spaced electrical conductors stationarily mounted to said cap, said each of said conductors having a free end located within said gap in closely spaced proximity to said circular electrical current-conducting element for transferring electrostatic energy thereto when said stationary electrical conductors are energized from a high voltage source for facilitating contact charging of liquid coating supplied to said first surface when said coating flows outwardly over said first surface in contact with said charging electrode toward said atomizing edge.

32. The apparatus of claim 31 wherein said circular electrical current-conducting element is located recessed within said cap.

33. The apparatus of claim 32 further comprising, a charging resistor connected electrically in series with each of said plural circumferentially spaced electrical conductors, each of said charging resistors being at least partially imbedded within said cap.

34. Electrostatic rotary atomizing liquid spray coating apparatus comprising:

a generally cylindrically shaped support body having forward and rear sections disposed on opposite sides of an intermediate section, said intermediate section having a diameter substantially less than that of said forward and rear body sections to define an annular cavity therebetween, a frusto-conically shaped tubular rotary atomizer of insulative material having an inner surface and an outer surface extending between a rear edge and a forward atomizing edge, with the diameter of the forward edge exceeding the diameter of the rear edge, said atomizer having an axis of rotation, a circular charging electrode mounted on said inner surface encircling said axis of rotation, a circular current-conducting element mounted on said outer surface encircling said axis of rotation, a cap on the forward section of said support body, said cap having an outer face whose shape is adapted to provide a substantially laminar flow of air thereacross as said rotary atomizer rotates about said axis of rotation during normal operation, means mounted to said rotary atomizer for electrically connecting said circular electrode and said circular element, drive means for rotating said rotary atomizer about its axis of rotation, said drive means including (a) an air turbine located within a cavity in said rear body support section, (b) a drive shaft connected between said turbine and said rotary atomizer and extending through a bore in said forward body support section, and (c) an air bearing located in a cavity in said intermediate body support section for rotatably supporting said shaft, means for supplying liquid coating to said inner surface of said rotary atomizer when said atomizer is rotating about its rotational axis, said means including (a) a liquid coating valve mounted in said annular cavity proximate said forward section of said support body, and (b) a liquid coating nozzle mounted on said forward body support section in proximity to said inner surface of said rotary atomizer, and (c) a liquid coating conduit interconnecting said liquid coating valve and said liquid coating nozzle for transporting liquid coating to said liquid coating nozzle under control of said liquid coating valve, plural electrical conductors stationarily extending from said cap at circumferentially spaced intervals, each said conductor having a free end located in closely spaced proximity to said circular conducting element for transferring electrostatic energy thereto when said stationary electrical conductors are energized from a high voltage source for facilitating contact charging of liquid coating supplied to said inner surface of said rotary atomizer when said coating flows forwardly and outwardly over said inner surface in contact with said charging electrode toward said atomizing edge under centrifugal force produced by rotation of said rotary atomizer.

35. The apparatus of claim 34 wherein said cap further comprises, air flow means for establishing a generally forwardly directed flow of air, and a repulsion ring to electrostatically repel charged liquid coating material atomized by said rotary atomizer.

36. The apparatus of claim 35 wherein said air flow means comprises, at least one air passage located rearwardly of said atomizing edge, and means for supplying air under pressure to said passages.

37. The apparatus of claim 36 wherein said passages are disposed in an array surrounding said rotary atomizer to establish a corresponding array of air jets for shaping and generally forwardly projecting said spray pattern.

38. Electrostatic rotary atomizing liquid spray coating apparatus comprising:

a support body, a frusto-conically shaped tubular rotary atomizer of insulative material supported by said support body, said atomizer cup having an inner surface and an outer surface extending between a rear edge and a forward atomizing edge, with the diameter of the forward edge exceeding the diameter of the rear edge, said atomizer having an axis of rotation, means for supplying liquid coating material to said atomizer cup to form an atomized spray pattern of coating material, electrostatic charging means for imparting an electrostatic charge to said coating material, a cap included on the forward section of said support body, said cap including a generally convex outer face along at least a portion thereof, said outer face being adapted to provide a substantially laminar flow of air thereacross as said rotary atomizer rotates about said axis of rotation during normal operation, air flow means located rearward of said atomizing edge for establishing a generally forwardly directed flow of air, and a repulsion ring adapted to be energized to a polarity the same as the polarity of said electrostatic charge imparted to said coating material, whereby said outer face of said cap, said air flow means and said repulsion ring cooperate to urge said spray pattern generally forwardly of said rotary atomizer.

39. The apparatus of claim 38 wherein said cap further includes a recess, said rotary atomizer being at least partially disposed within said recess.

40. The apparatus of claim 38 wherein said air flow means comprises, at least one air passage located rearwardly of said atomizing edge, and means for supplying air under pressure to said passages.

41. The apparatus of claim 40 wherein said passages are disposed in an array surrounding said rotary atomizer to establish a corresponding array of air jets for shaping and generally forwardly projecting said spray pattern.

42. Electrostatic rotary atomizing liquid spray coating apparatus comprising:

a support body of insulative material having forward, intermediate, and rear sections, a rotary atomizer of insulative material having an axis of rotation, a first surface over which liquid coating can flow outwardly to an atomizing edge thereof when said atomizer is rotated about said axis of rotation, and a second surface separated from said first surface by said atomizing edge, charging means extending through said atomizer between said first and second surfaces for charging said liquid coating, said charging means having an outer portion positioned proximate said second surface and an inner portion positioned proximate said first surface to be contacted by liquid coating material flowing outwardly over said first surface, drive means incorporated in said support body drivingly mounting said rotary atomizer to said forward section of said support body for rotating said rotary atomizer about said axis of rotation, means for supplying liquid coating to said first surface of said rotary atomizer when said atomizer is rotating about its rotational axis, and at least one electrical conductor stationarily mounted to said forward section of said support body, said conductor having a free end located in closely spaced proximity to said outer portion of said charging means for transferring electrostatic energy to the charging means when said stationary electrical conductor is energized from a high voltage source for facilitating charging of liquid coating supplied to said first surface when said coating flows outwardly over said first surface in contact with said outer portion of said charging means toward said atomizing edge.

43. The apparatus of claim 42 wherein said inner portion of said charging means comprises:

a circular ring-shaped charging electrode mounted on said first surface encircling said axis of rotation.

44. The apparatus of claim 43 wherein said charging means further comprises:

a plurality of posts extending through said atomizer and electrically connected to said ring on said first surface, each of said posts having ends proximate said second surface forming the outer portion of said charging means.

45. The apparatus of claim 42 wherein said charging means further comprises:

a plurality of discrete charging electrodes extending through said atomizer from said first to said second surfaces, said electrodes being circumferentially spaced about the atomizer axis of rotation, the inner portion of said charging means comprising the inner ends of said electrodes and the outer portion of said charging means comprising the outer ends of said electrodes.

46. The apparatus of claim 45 wherein the number of said electrodes is at least eight in number.

47. The apparatus of claim 42 wherein the charging means is formed at least in part of semiconductive material.

* * * * *

UNITED STATES PATENT AND TRADEMARK OFFICE

CERTIFICATE OF CORRECTION

PATENT NO. : 4,887,770
DATED : December 19, 1989
INVENTOR(S) : Wacker, et al

It is certified that error appears in the above-identified patent and that said Letters Patent is hereby corrected as shown below:

In claim 42, in column 26, line 7, delete "outer" and insert therefor –inner--.

Signed and Sealed this

Twenty-fourth Day of August, 1999

*Attest:*

Q. TODD DICKINSON

*Attesting Officer*

*Acting Commissioner of Patents and Trademarks*

US004887770B1

REEXAMINATION CERTIFICATE (2022nd)

United States Patent [19] [11] B1 4,887,770

Wacker et al. [45] Certificate Issued May 25, 1993

[54] ELECTROSTATIC ROTARY ATOMIZING LIQUID SPRAY COATINGS APPARATUS

[75] Inventors: Robert L. Wacker, Wellington; Donald E. Shuster, Elyria; John Sharpless, Oberlin; Alan J. Knobbe, Lorain; James C. Murphy, Broadview Heights, all of Ohio

[73] Assignee: Nordson Corporation, Westlake, Ohio

Reexamination Request:
No. 90/002,690, Apr. 3, 1992

Reexamination Certificate for:

| | |
|---|---|
| Patent No.: | **4,887,770** |
| Issued: | **Dec. 19, 1989** |
| Appl. No.: | **300,114** |
| Filed: | **Jan. 19, 1989** |

Certificate of Correction issued Jun. 18, 1991.

Related U.S. Application Data

[63] Continuation-in-part of Ser. No. 14,450, Feb. 13, 1987, abandoned, which is a continuation-in-part of Ser. No. 853,746, Apr. 18, 1986, abandoned.

[51] Int. Cl.[5] ..... B05B 5/04

[52] U.S. Cl. ..... 239/703; 239/691; 239/110; 239/224

[58] Field of Search ..... 239/700–703, 239/222.11, 223, 224, 690, 691, 104, 106, 110

[56] References Cited

U.S. PATENT DOCUMENTS 4,576,827 3/1986 Hastings et al. ..... 239/706

*Primary Examiner*—Andres Kashnikow

[57] ABSTRACT

Electrostatic liquid spray coating apparatus including a rotary atomizing cup of insulaive material driven by an air turbine, is provided with a semi-conductive charging device extending through the cup, the inner portion of which is proximate the inner surface of the cup for contact charging liquid coating material supplied to the rear of the cup as it flows forwardly and outwardly over the rotating cup interior and contacts the charging device prior to atomization at the forward edge of the cup. A generally cylindrical insulative support body, housing a turbine and its associated air bearing and cup drive shaft, has a reduced diameter intermediate section which provides an annular cavity in which are located liquid coating and solvent valves for controlling the flow of liquid coating and solvent to the cup. The charging means in the cup is energized via a stationary conductor which terminates in closely spaced proximity to the outer portion of the charging device on the cup exterior which is electrically connected to the inner portion of the charging device on the cup interior via a series of semi-conductive posts which form the portion of the charging device extending through the wall of the cup between its inner and outer surfaces.

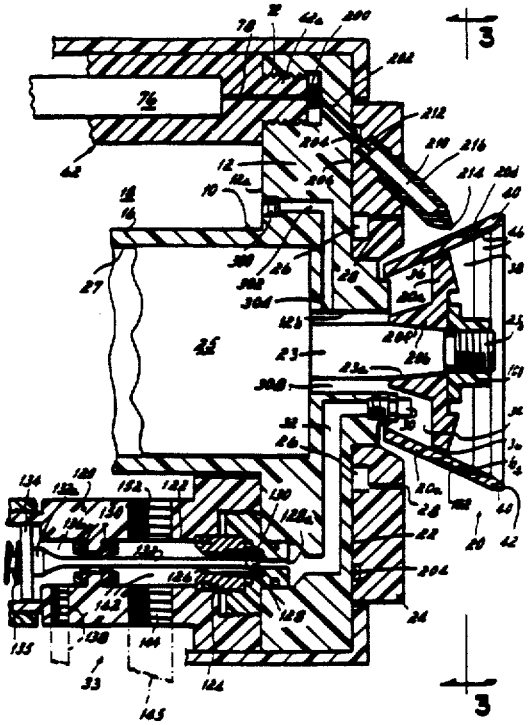

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 16, language is to be inserted before "What is claimed is:" (after line 47):

*In the embodiments of FIGS. 1-11, 12 and 13, the inner portion of the charging means 46, 546 and 646, respectively, is preferably recessed in the inner wall surface of the atomizer 20.*

AS A RESULT OF REEXAMINATION, IT HAS BEEN DETERMINED THAT:

The patentability of claims 1-26 and 28-41 is confirmed.

Claims 27 and 42 are determined to be patentable as amended.

Claims 43-47, dependent on an amended claim, are determined to be patentable.

New claims 48—56 are added and determined to be patentable.

27. The apparatus of claim [25] *26* wherein said circular electrode and circular element are semiconductive.

42. Electrostatic rotary atomizing liquid spray coating apparatus comprising:

a support body of insulative material having forward, intermediate, and rear sections, a rotary atomizer of insulative material having an axis of rotation, a first surface over which liquid coating can flow outwardly to an atomizing edge thereof when said atomizer is rotated about said axis of rotation, and a second surface separated from said first surface by said atomizing edge, charging means extending through said atomizer between said first and second surfaces for charging said liquid coating, said charging means having an outer portion positioned proximate said second surface and an inner portion positioned proximate said first surface to be contacted by liquid coating material flowing outwardly over said first surface, drive means incorporated in said support body drivingly mounting said rotary atomizer to said forward section of said support body for rotating said rotary atomizer about said axis of rotation, means for supplying liquid coating to said first surface of said rotary atomizer when said atomizer is rotating about its rotational axis, and

[at least one electrical conductor stationarily mounted to said forward section of said support body,] *plural electrical conductors stationarily mounted to the forward section of said support body at circumferentially spaced locations relative thereto,* said [conductor] *conductors each* having a free end located in closely spaced proximity to said outer portion of said charging means for transferring electrostatic energy to the charging means when said stationary electrical [conductor is] *conductors are* energized from a high voltage source for facilitating *contact* charging of *the* liquid coating supplied to said first surface when said coating flows outwardly over said first surface [in contact with] *and contacts* said *charged* outer portion of said charging means *while flowing* toward said atomizing edge.

*48. The apparatus of claim 42 wherein said inner portion of said charging means is recessed into said first surface.*

*49. The apparatus of claim 42 wherein said inner portion of said charging means is a flat circular ring-shaped electrode which is mounted to said first surface.*

*50. The apparatus of claim 42 wherein there are at least three stationarily mounted conductors which are substantially equally circumferentially spaced relative to said axis of rotation.*

*51. The apparatus of claim 42 or 48 or 49 or 50 wherein said charging means includes means for electrically interconnecting said inner and outer portions of said charging means at a plurality of locations which are circumferentially spaced around said atomizer axis of rotation.*

*52. The apparatus of claim 42 or 48 or 49 or 50 wherein said charging means includes a plurality of circumferentially spaced posts extending through said atomizer, said posts having inner and outer ends, said inner and outer portions of said charging means comprising said inner and outer ends of said posts, respectively.*

*53. The apparatus of claim 42 or 48 or 49 or 50 wherein said charging means includes means for electrically interconnecting said inner and outer portions of said charging means at a plurality of locations which are substantially equally circumferentially spaced around said atomizer axis of rotation.*

*54. The apparatus of claim 42 or 48 or 49 or 50 wherein said charging means includes a plurality of substantially equally circumferentially spaced posts extending through said atomizer, said posts having inner and outer ends, said inner and outer portions of said charging means comprising said inner and outer ends of said posts, respectively.*

*55. The apparatus of claim 54 wherein said posts are disposed generally parallel to the rotational axis of said rotary atomizer.*

*56. The apparatus of claim 42 wherein said forward section of said support body includes a recess in which said rotary atomizer is at least partially disposed to define a gap between said forward section and said second surface of said rotary atomizer, said outer portion of said charging means and said free ends of said conductors each being disposed substantially within said gap whereby said free ends and said outer portion of said charging means are afforded substantial protection against inadvertent contact.*

* * * * *